United States Patent [19]

Kashiwaya et al.

[11] Patent Number: 4,524,739

[45] Date of Patent: Jun. 25, 1985

[54] ENGINE CONTROL METHOD

[75] Inventors: Mineo Kashiwaya; Kiyomi Morita; Masahide Sakamoto, all of Katsuta, Japan

[73] Assignee: Hitachi, Ltd., Tokyo, Japan

[21] Appl. No.: 555,015

[22] Filed: Nov. 25, 1983

[30] Foreign Application Priority Data

Nov. 24, 1982 [JP] Japan ..... 57-204667

[51] Int. Cl.[3] ..... F02D 11/10

[52] U.S. Cl. ..... 123/339; 123/585; 123/179 G

[58] Field of Search ..... 123/339, 340, 585, 179 L, 123/179 G

[56] References Cited

U.S. PATENT DOCUMENTS

| | | | |
|---|---|---|---|
| 3,964,457 | 6/1976 | Coscia | 123/339 |
| 4,237,838 | 12/1980 | Kinugawa | 123/339 |
| 4,344,398 | 8/1902 | Ikeura | 123/339 |
| 4,364,348 | 12/1982 | Itoh | 123/339 |
| 4,387,682 | 6/1983 | Miyagi | 123/339 |
| 4,391,244 | 7/1983 | Kobashi | 123/339 |
| 4,392,468 | 7/1983 | Kobayashi | 123/339 |
| 4,406,261 | 9/1983 | Ikeura | 123/339 |
| 4,414,943 | 11/1983 | Nagase | 123/339 |

*Primary Examiner*—Ronald B. Cox

*Attorney, Agent, or Firm*—Antonelli, Terry & Wands

[57] ABSTRACT

An engine control method for an engine control system comprising a central processing unit for computing a value of duty factor for a by-pass valve in response to the respective outputs of a plurality of sensors for detecting operating conditions of the engine and a pulse generating circuit responsive to the output of the central processing unit for supplying the by-pass valve with a pulse signal representing the computed value of duty factor. The engine control method comprises a step of computing the duty factor for the by-pass valve on the basis of the outputs of the sensors in an idling operation of the engine, and a step of supplying the by-pass valve with a pulse signal representing a predetermined duty factor on the basis of the computed value of duty factor.

12 Claims, 56 Drawing Figures

FIG. 7

| TASK LEVEL | $2^7$ | | | | | $2^2$ | $2^1$ | $2^0$ |
|---|---|---|---|---|---|---|---|---|
| "0" --- | $R_0$ | | | | | $Q_2$ | $Q_1$ | $Q_0$ |
| "1" --- | $R_1$ | | | | | $Q_2$ | $Q_1$ | $Q_0$ |
| "2" --- | $R_2$ | | | | | $Q_2$ | $Q_1$ | $Q_0$ |

FIG. 8

| START ADDRESS | |
|---|---|
| SA0 --- | START ADDRESS FOR TASK NO. 0 |
| SA1 --- | START ADDRESS FOR TASK NO. 1 |
| SA2 --- | START ADDRESS FOR TASK NO. 2 |
| | |
| | |
| SA7 --- | START ADDRESS FOR TASK NO. 7 |
| SA8 --- | START ADDRESS FOR TASK NO. 8 |

ENGINE CONTROL METHOD

CROSS REFERENCE OF RELATED APPLICATIONS

This application relates to the subject matter of a copending U.S. application Ser. No. 471,435 filed on Mar. 2, 1983.

The present invention relates to an engine control method for a motor vehicle employing a microcomputer, and, more particularly, to an engine control method in which the engine revolution can be controlled stably and/or smoothly during an idling operation.

Recently, general control for an engine has been performed by using a microcomputer for the purpose of improving engine control performance.

Various functions are required for the engine control depending on the kind or type/use of car, and, therefore, in the engine control system utilizing a microcomputer, a general purpose software, that is a software in which correction, modification or addition can be effected onto the various control functions depending on the kind/use of the motor vehicle, is required in order to improve overall cost and/or controllability.

Conventionally, the amount of suction air in an engine has been indirectly detected on the basis of the pressure in a suction manifold, or the total amount of suction air per suction stroke has been obtained by directly detecting the air flow rate. Disadvantages of the indirect method resides in the fact that the accuracy is poor, the variations and/or deterioration in performance of the engine may affect the detection, and the responsiveness is poor. A disadvantage of the direct detecting method resides in the fact that a flow rate sensor having high accuracy (error: within +1% of read value) and a wide dynamic range (1:50) is required, resulting in an increase in cost. Preferably a so-called hot-wire type flow rate sensor (hereinafter referred to as a hot-wire sensor) has been employed as the flow rate sensor, because the hot-wire sensor has a characteristic allowing a wide dynamic range and reduction in cost can be expected.

However, the suction air flow rate in an engine is not constant but is pulsating, so that the output signal from a flow rate sensor has a non-linear characteristic with respect to the suction air flow. Therefore, it becomes necessary to obtain the air flow rate in suction stroke in the form of integration of instantaneous air flow rates, and complex operations are required for the integration. That is, the hot-wire output voltages v shown in FIG. 1 can be obtained according to the following equation:

$$v = \sqrt{C_1 + C_2\sqrt{qA}} \tag{1}$$

where $q_A$ represents the mass flow rate and $C_1$, $C_2$ represent constants determined by the shape of intake manifold etc. This equation (1) can be changed into the following equation:

$$v^2 = C_1 + C_2\sqrt{qA} \tag{2}$$

Assuming now that $v=v_0$ when the rotational number of engine $N=0$, and the mass flow rate $q_A=0$, equation (2) is expressed as follows:

$$v_0^2=C_1 \tag{3}$$

Thus, the following equations (4) and (5) are derived from the equations (2) and (3) and an instantaneous value of mass flow rate $q_A$ can be obtained from the equation (5).

$$v^2 = v_0^2 + C_2\sqrt{qA} \tag{4}$$

$$qA = \frac{1}{C_2^2}(v^2 - v_0^2)^2 \tag{5}$$

Thus, the average or mean air flow rate in one suction stroke $Q_A$ can be expressed as follows:

$$Q_A = \frac{q_{A1}\cdot\Delta\theta + q_{A2}\cdot\Delta\theta + \ldots q_{An}\cdot\Delta\theta}{n\cdot\Delta\theta} = \frac{\sum_{n=1}^{n} q_{An}}{n} \tag{6}$$

where $\Delta\theta$ represents a crank angle between two adjacent sampling points of $q_A$.

Further, the amount of fuel injection $Q_F$ for one suction stroke can be expressed by the following equation:

$$Q_F = \frac{kQ_A}{N} \tag{7}$$

where N represents the number of engine revolutions, and k a constant. This means that the amount of fuel injection $Q_F$ for one stroke can be determined on the basis of the obtained value of $Q_A$ and the number of engine revolutions N.

Conventionally, during an idling operation of an engine, that is, in the ON state of an idling switch, the ON duty factor of a by-pass valve is determined on the basis of the sum of a value determined in accordance with the cooling water of the engine and a value representing the quantity of feedback of the number of engine revolutions for controlling the number of engine revolutions to be a reference number of engine revolutions for an idle operation. In an idling operation, however, it is difficult to control the number of engine revolutions represent the reference number of engine revolutions for an idle operation stably and/or smoothly, when the engine running condition changes, that is, for example, upon the occurrence of changes in the state of engine in starting operation to shift from the state of starting by the engine starter motor into the state of self cranking, changes in the ON/OFF state of the idling switch, and changes in the state of load of the engine.

An object of the present invention is to provide an engine control method in which the number of engine revolutions can be controlled stably and/or smoothly to be a reference number of engine revolutions for an idling operation of the engine upon the occurence of changes in operating condition of the engine in the idling operation.

To this end, the present invention computes a duty factor for a by-pass valve on the basis of the outputs of sensors, for detecting operating conditions of an engine in an idling operation and supplies the by-pass valve with a pulse signal representing a predetermined duty factor on the basis of the computed value of duty factor. The above and other objects, features and advantages of the present invention will be more clear from the following description with reference to the accompanying drawings, in which:

FIG. 7 is a diagram showing a table of task control blocks provided in RAM controlled by a task dispatcher;

FIG. 8 is a diagram showing a start address table for the tasks actuatable by various interruptions;

Figure 17:
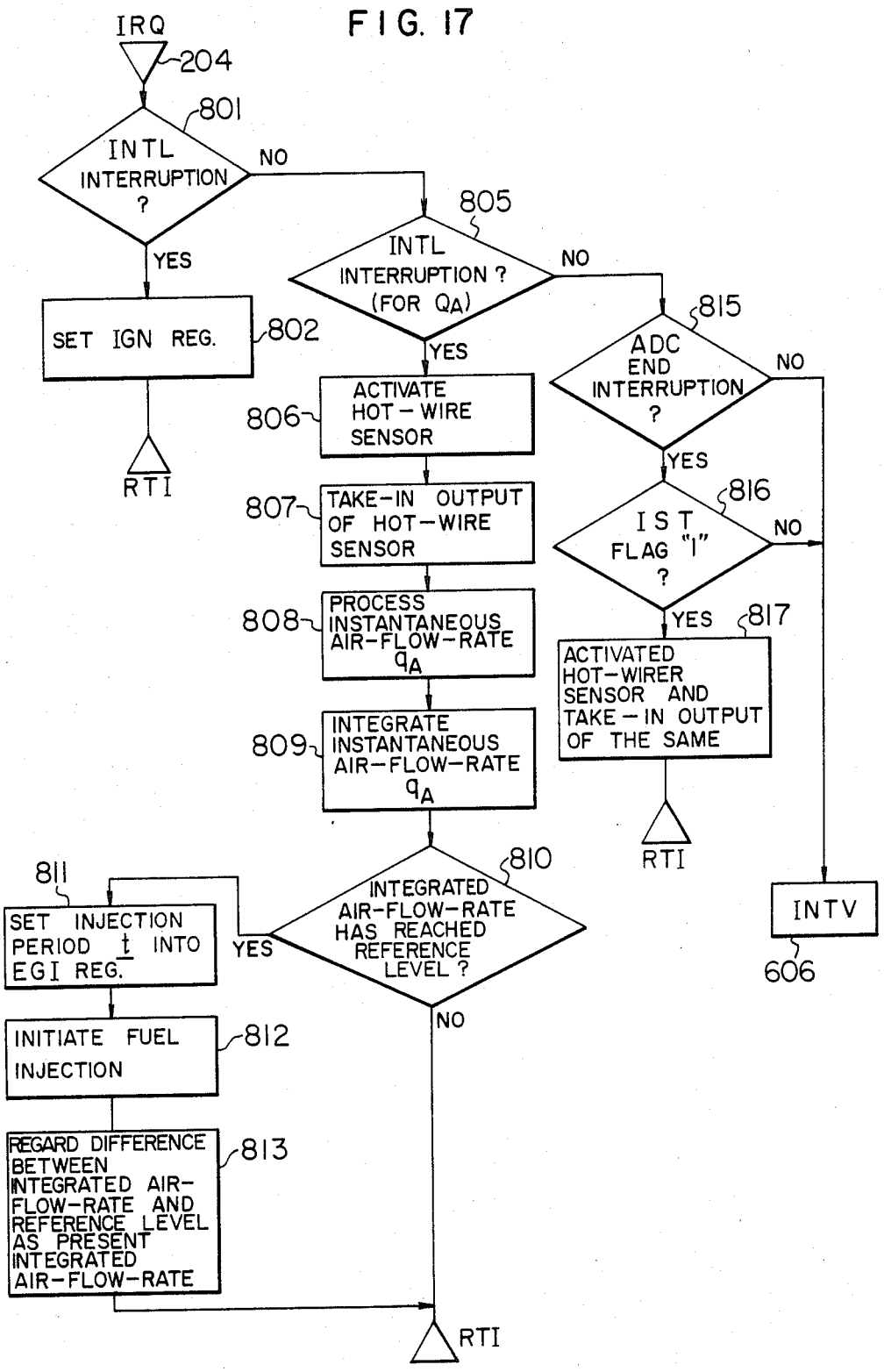
Figure 18:
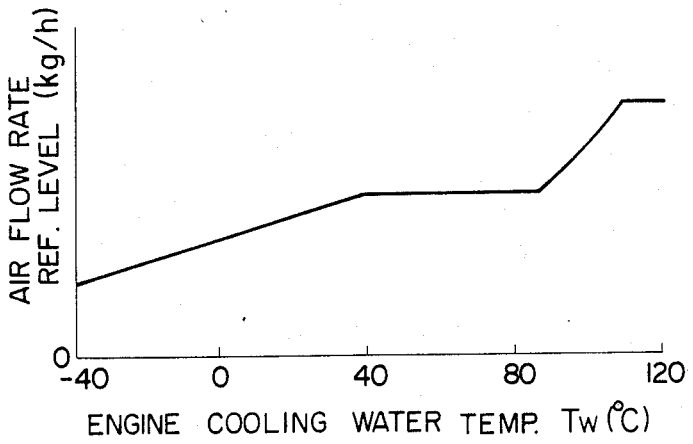
Figure 19:
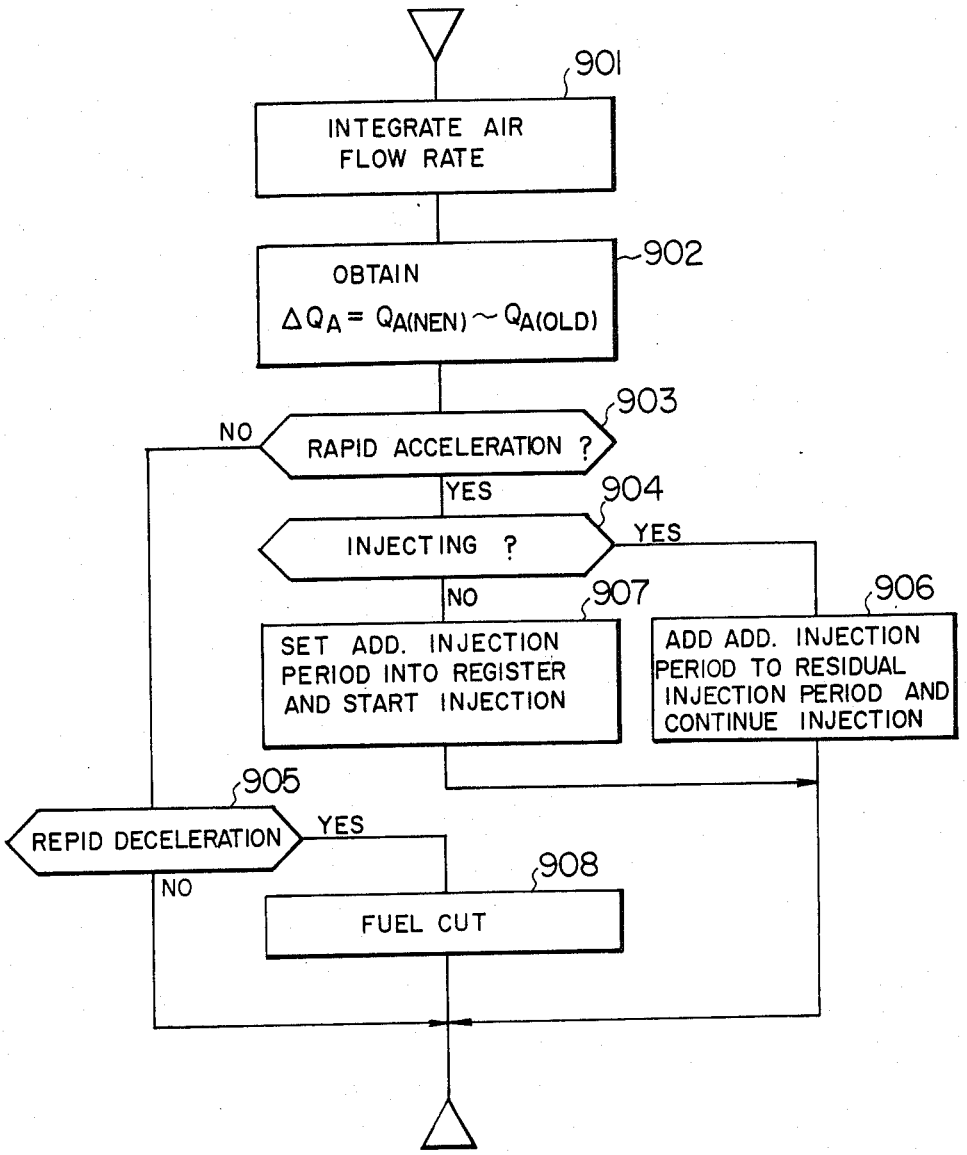
Figure 20:
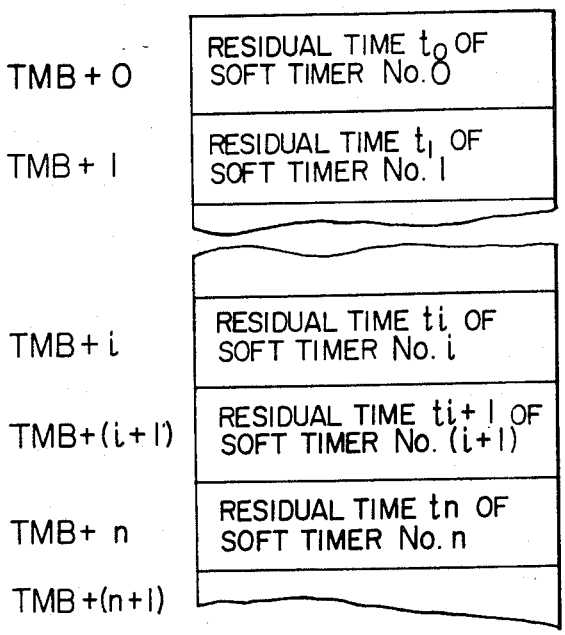
Figure 21:
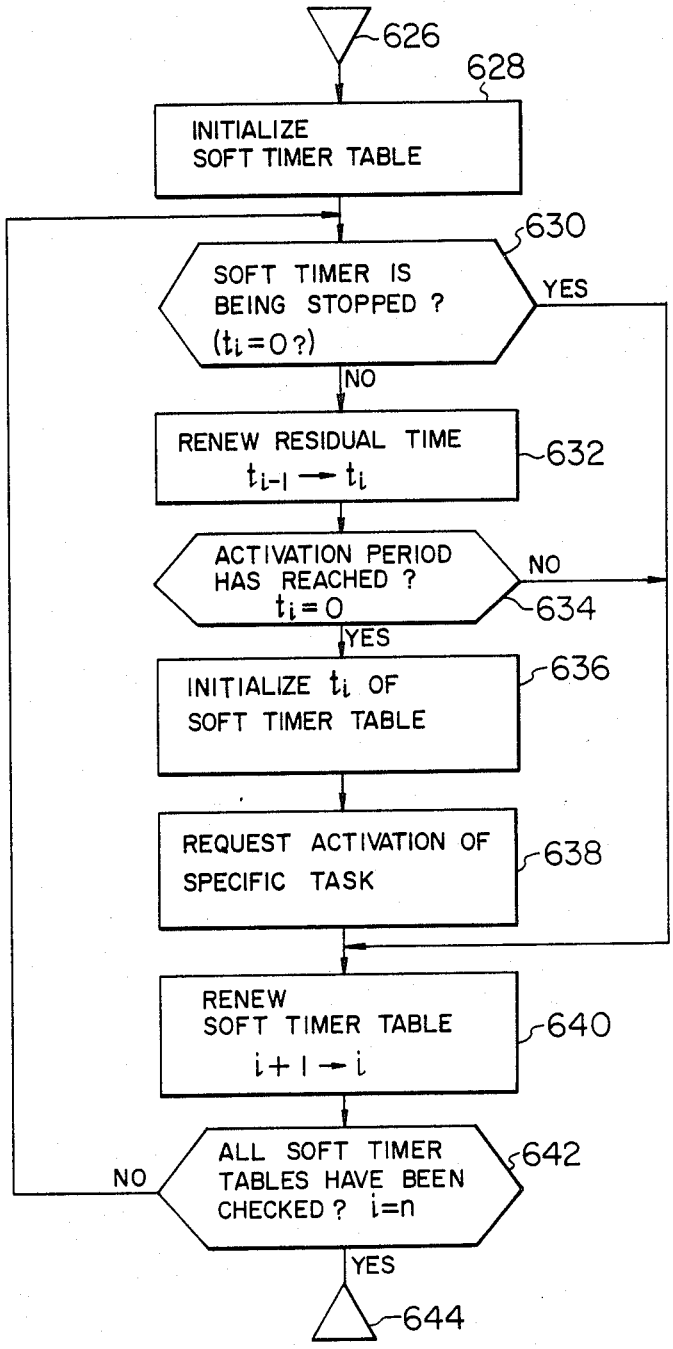
Figure 22:
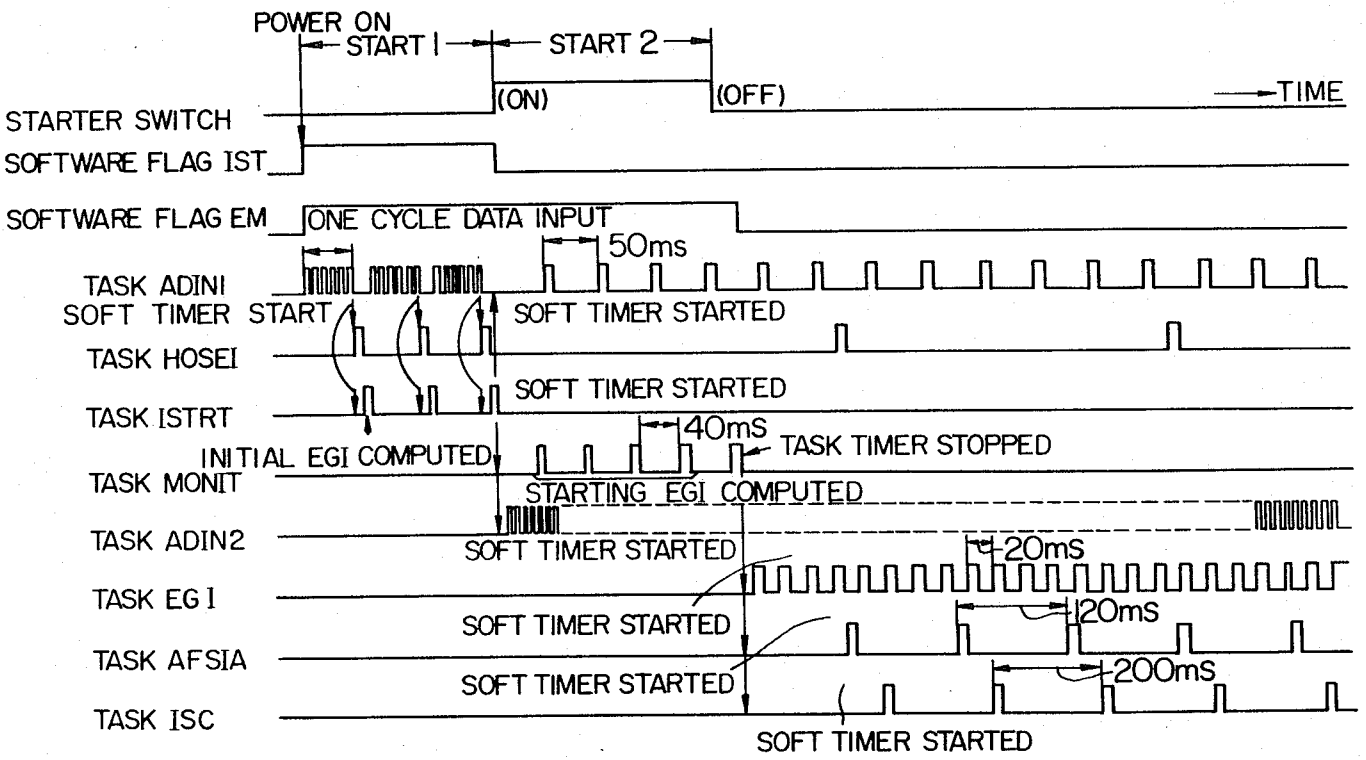
Figure 23:
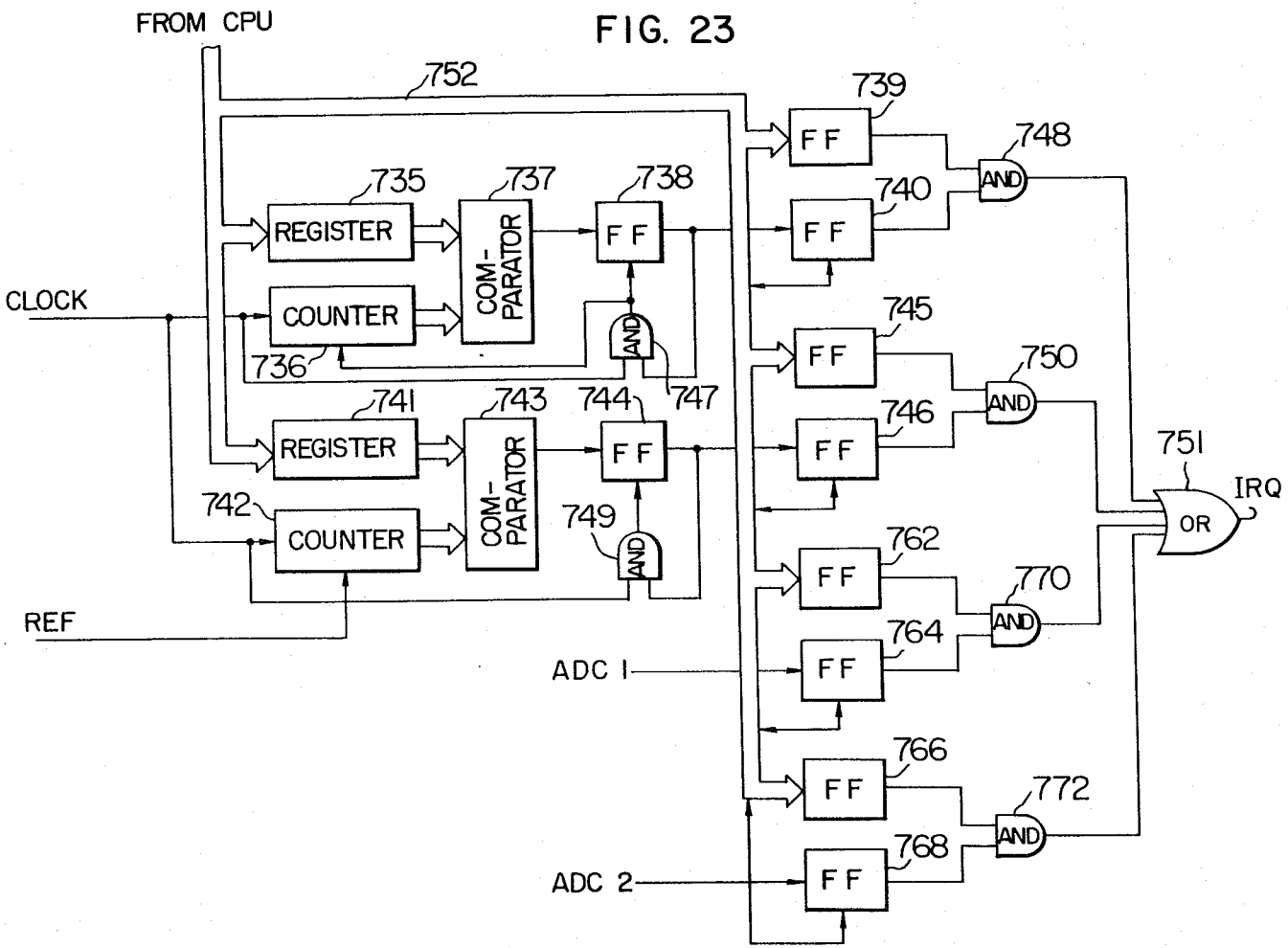
Figure 24:
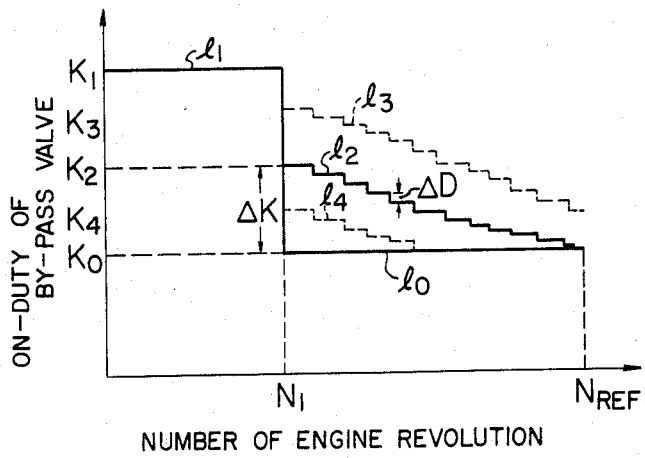
Figure 25:
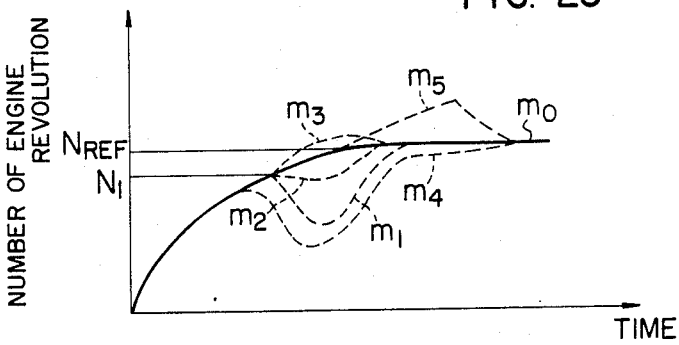
Figure 26:
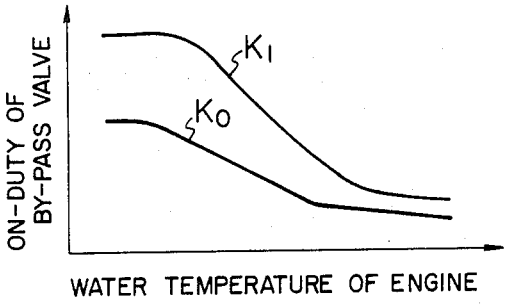
Figure 27:
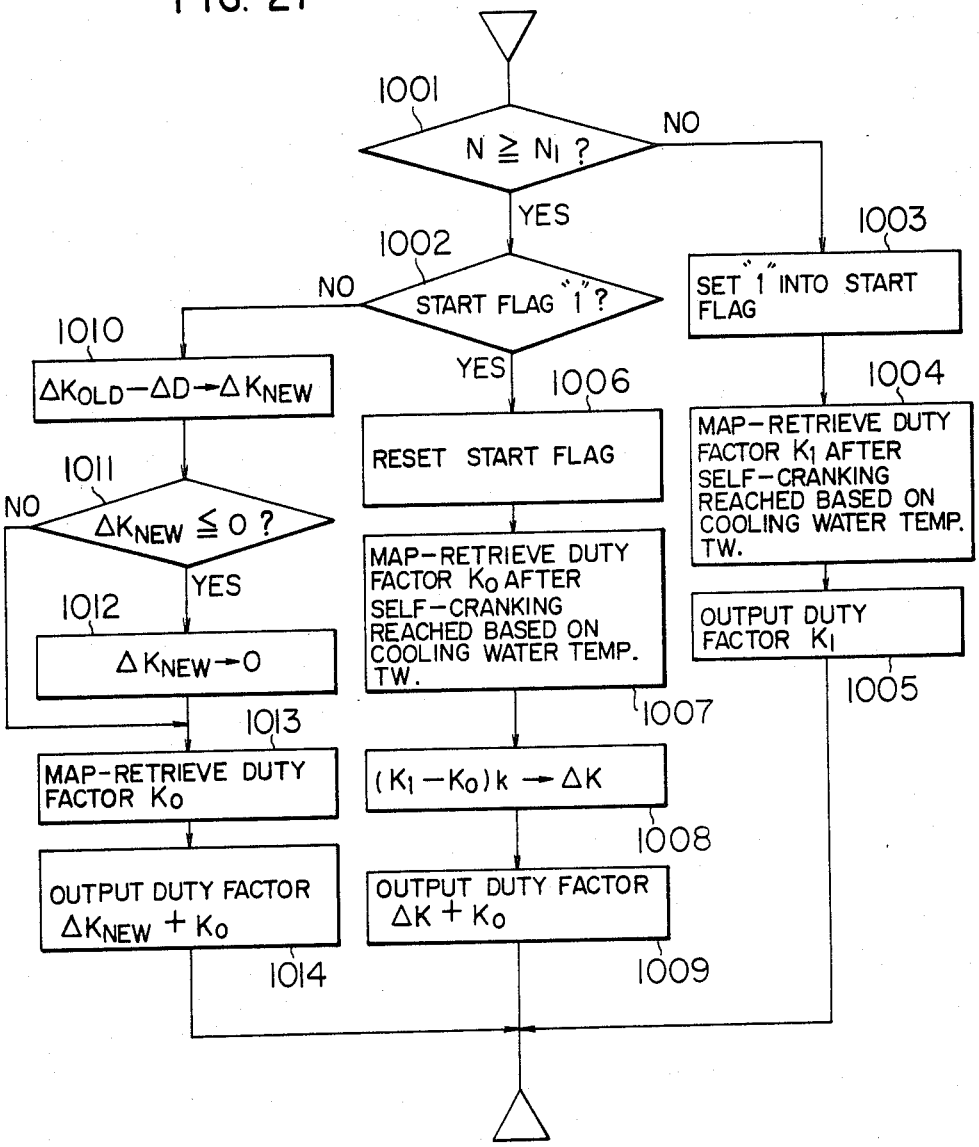
Figure 29:
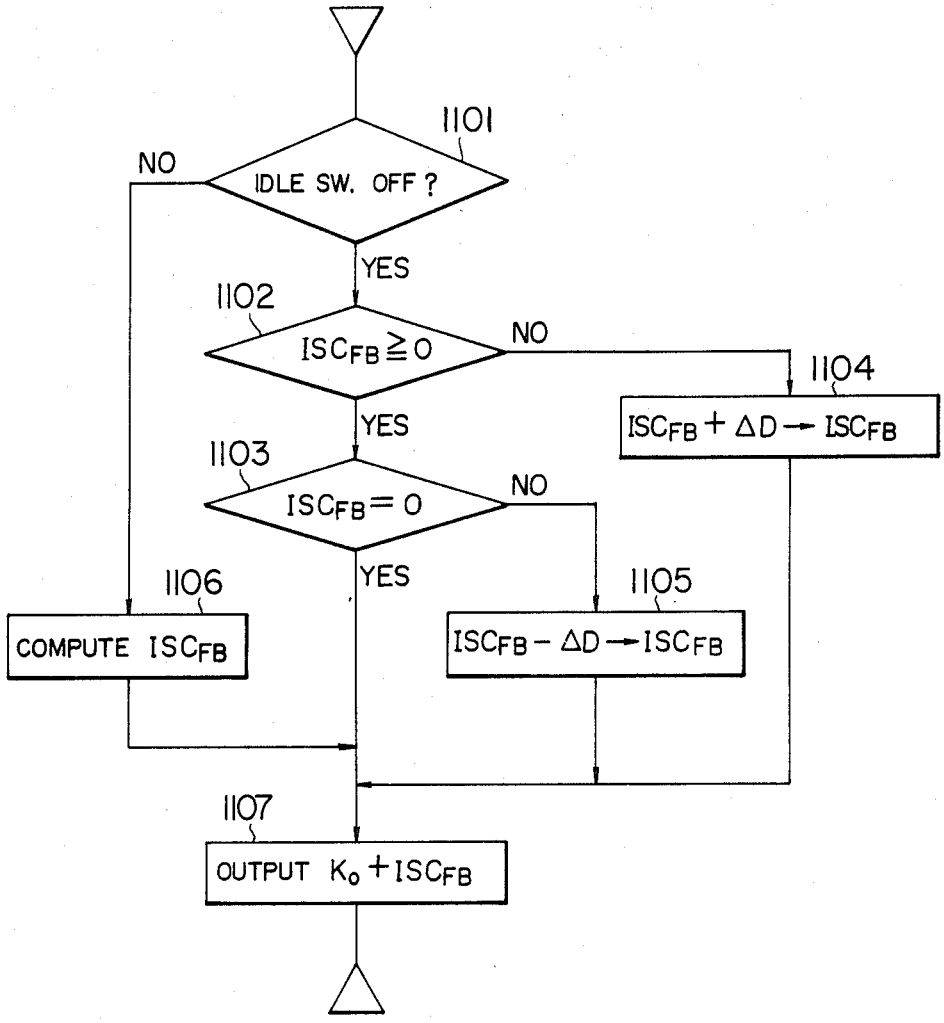
Figure 33:
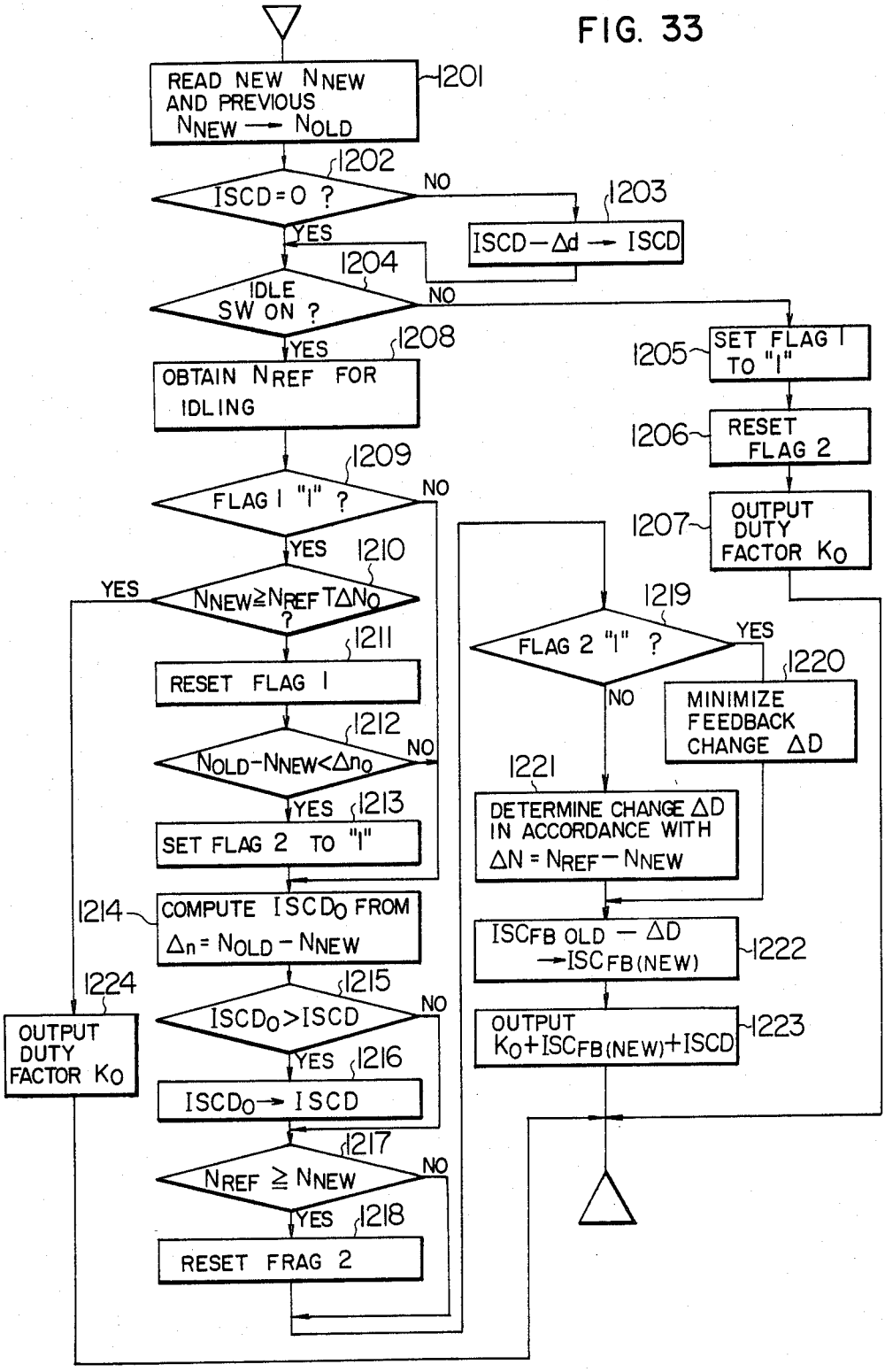
Figure 34:
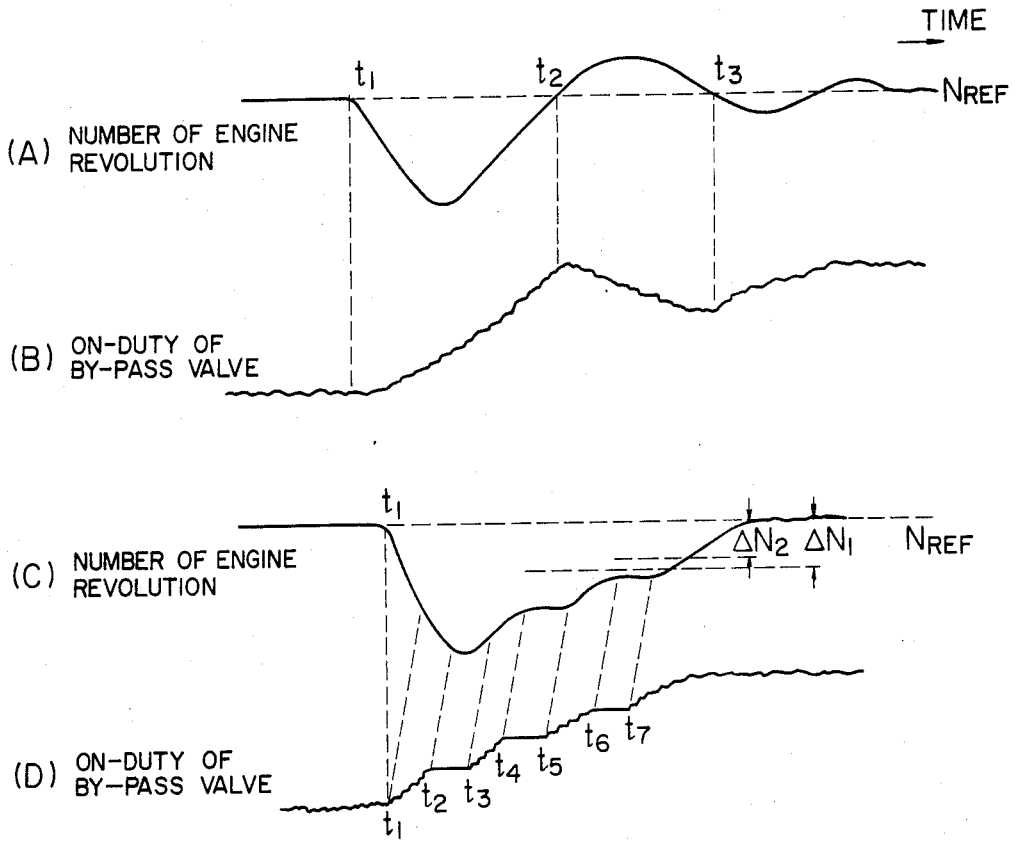
Figure 35:
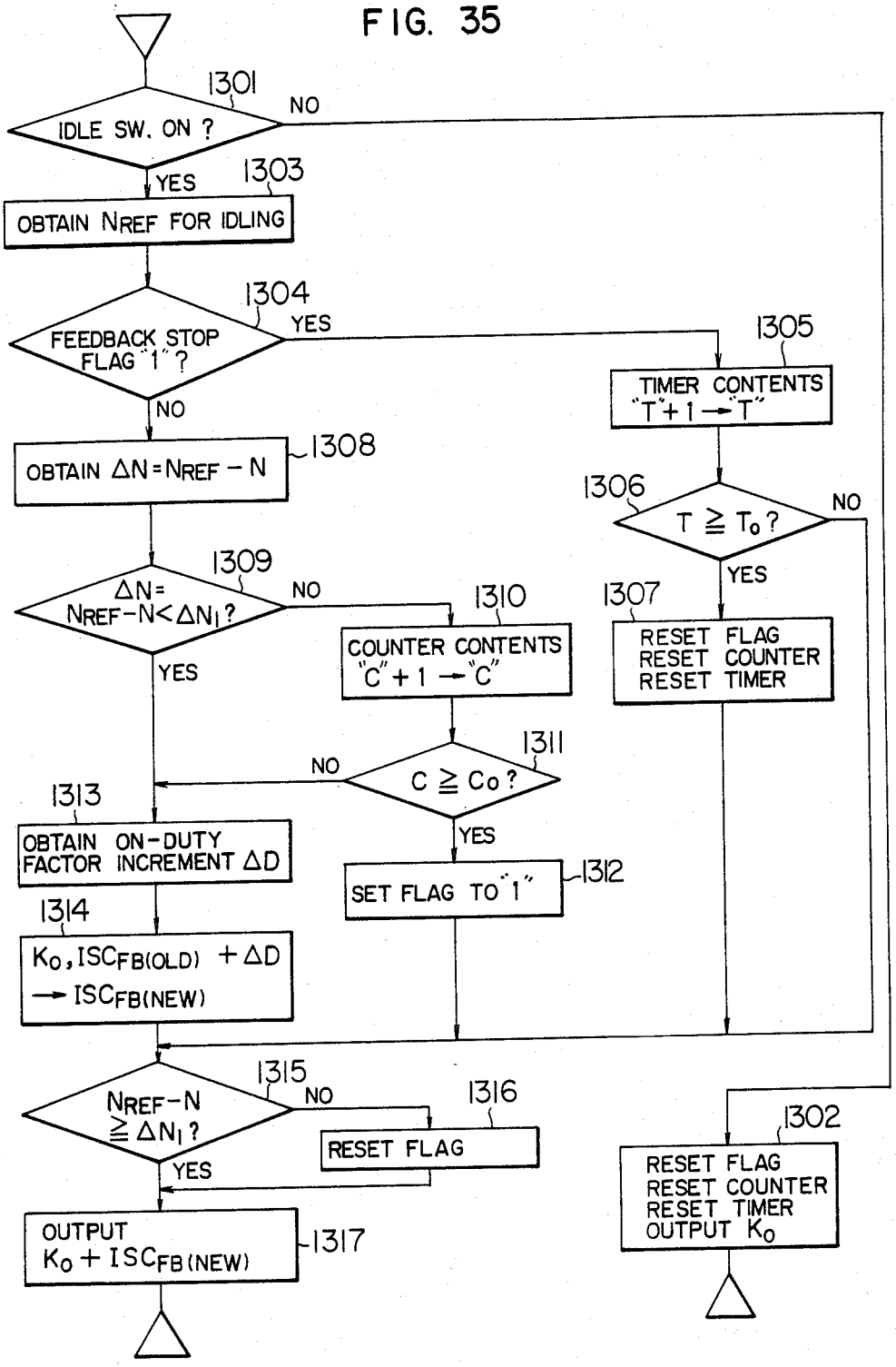

FIG. 16(A)–(C) is a diagram showing the relation between the suction air flow rate and the injection timing in the fuel injection system to which the present invention is applied;

FIG. 17 is a flowchart for processing the taking-in of an output signal of a hot wire type flow rate sensor and the timing of the fuel injection;

FIG. 18 is a diagram showing the alteration of an air flow rate reference value with respect to the temperature of engine cooling water;

FIG. 19 is a flow chart of processing in rapid acceleration/deceleration;

FIG. 20 is a diagram showing a soft timer table provided in RAM;

FIG. 21 is a flowchart for executing the processing of interval (INTV) interruption;

FIG. 22 is a time chart showing various states of start/stoppage of various tasks effected in accordance with the engine state;

FIG. 23 is a block diagram of the interruption request (IRQ) generating circuit;

FIG. 24 is a diagram showing the ISC open duty factor;

FIG. 25 is a diagram showing the characteristic of the number of engine revolutions;

FIG. 26 is a diagram showing the characteristic of duty factor with respect to engine cooling water temperature in the starting operation and the running operation;

FIG. 27 is a flowchart for processing the ISC duty;

FIG. 28(A)–(H) is a time chart of the idling switch and the ISC;

FIG. 29 is a time chart of processing;

FIG. 30(A)–(F) is a time chart from OFF to ON of the idling switch;

FIG. 31(A)–(D) is a time chart of the number of engine revolution and the ISC duty factor when the engine brake is actuated;

FIG. 32(A) is a time chart of the reduction in the number of engine revolutions;

FIG. 32(B) is a time chart of the ISC duty factor;

FIG. 33 is a flowchart of the ISC duty factor control in the loaded state;

FIG. 34(A)–(D) is a time chart of the number of engine revolutions and the ISC duty factor; and FIG. 35 is a flowchart of the ISC duty factor control.

Referring to the drawings, preferred embodiments of the present invention will be described hereunder.

Figure 1:
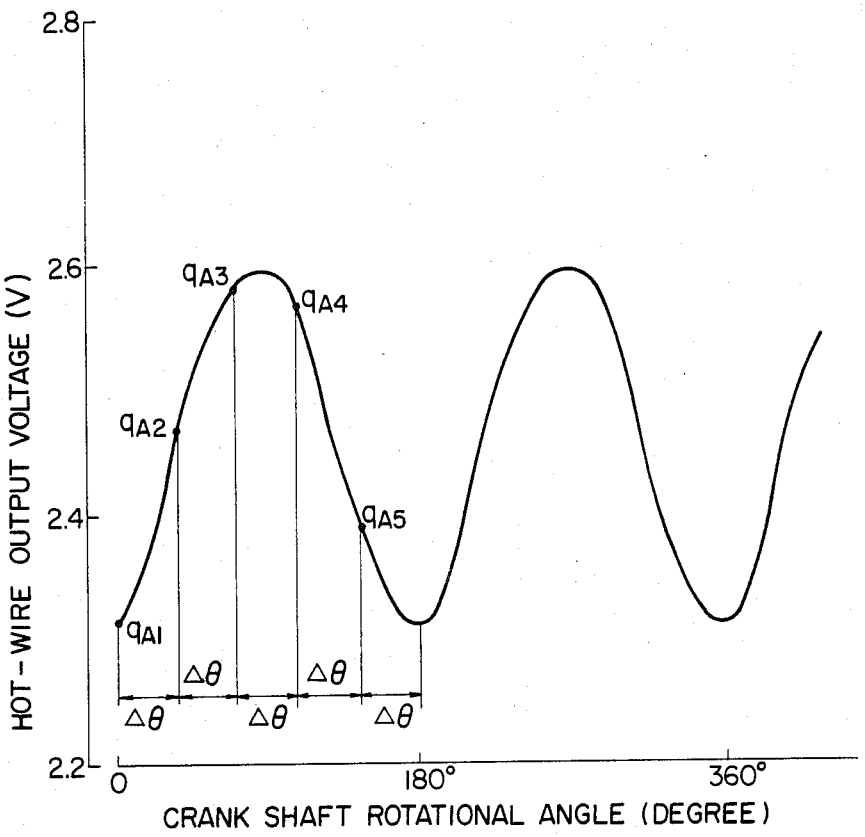
FIG. 1 is a characteristic diagram of the hot-wire sensor output voltage v with respect to the crank shaft rotational angle.
Figure 2:
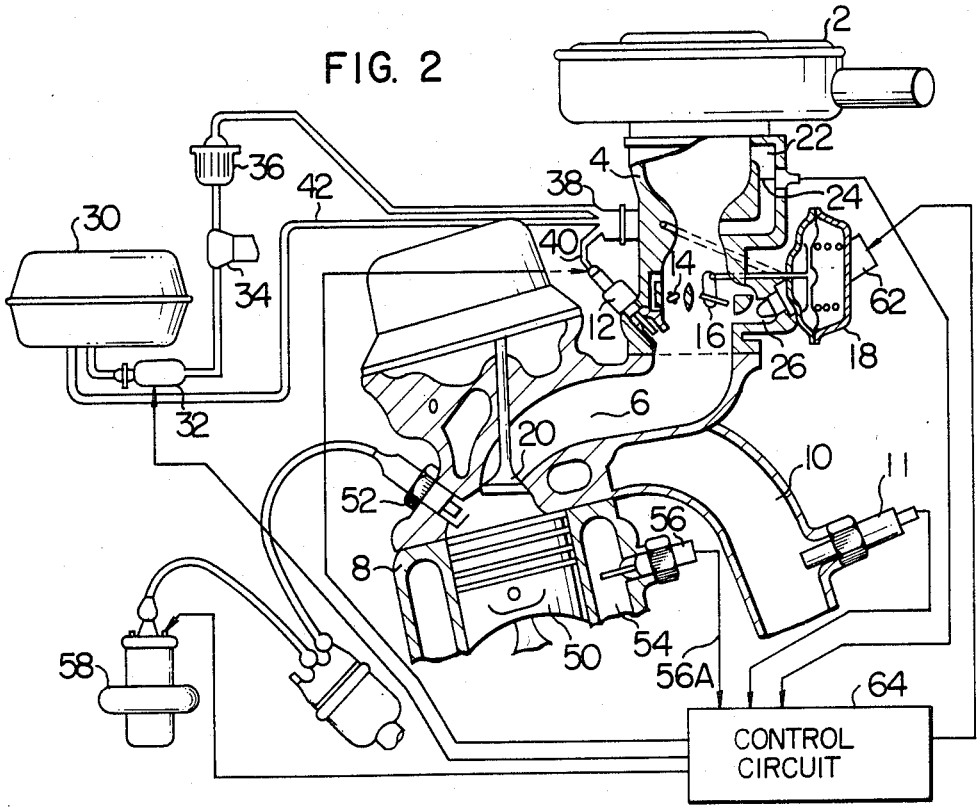
FIG. 2 is a schematic diagram of the control device for the whole of the engine system.

As shown in FIG. 2, suction air is supplied to a cylinder 8 through an air cleaner 2, a throttle chamber 4, and a suction pipe 6. A gas combusted in the cylinder 8 is discharged from the cylinder 8 to the atmosphere through an exhaust pipe 10. A fuel injector 12 is provided in the throttle chamber 4, with the fuel injected from the fuel injector 12 being atomized in an air path of the throttle chamber 4 and mixed with the suction air to form a fuel-air mixture which, in turn, is supplied to a combustion chamber of the cylinder 8 through the suction pipe 6 when a suction valve 20 is opened.

Throttle valves 14, 16 are provided in the vicinity of the output of the fuel injector 12, with the throttle valve 14 being arranged so as to be mechanically interlocked with an accelerator pedal (not shown) operated by the driver of the motor vehicle. The throttle valve 16 is driven by a diaphragm 18 such that it reaches a fully closed state in a range where the air flow rate is small, and as the air flow rate increases the negative pressure applied to the diaphragm 18 also increases so that the throttle valve 16 begins to open, thereby suppressing the increase of suction resistance.

An air path 22 is provided at the upper stream of the throttle valves 14 and 16 of the throttle chamber 4 and an electrical heater 24, constituting a thermal air flow rate meter, is disposed in the air path 22 so as to derive from the heater 24 and electric signal which changes in accordance with the air flow velocity which is determined by the relationship between the air flow velocity and the amount of heat transmission of the heater 24. By disposing the heater 24 in the air path 22, the heater 24 is protected from the high temperature gas generated in the period of back fire of the cylinder 8 as well as from the pollution by dust or the like in the suction air. The outlet of the air path 22 is opened in the vicinity of the narrowest portion of the venturi and the inlet of the same is opened at the upper stream of the venturi.

Figure 5:
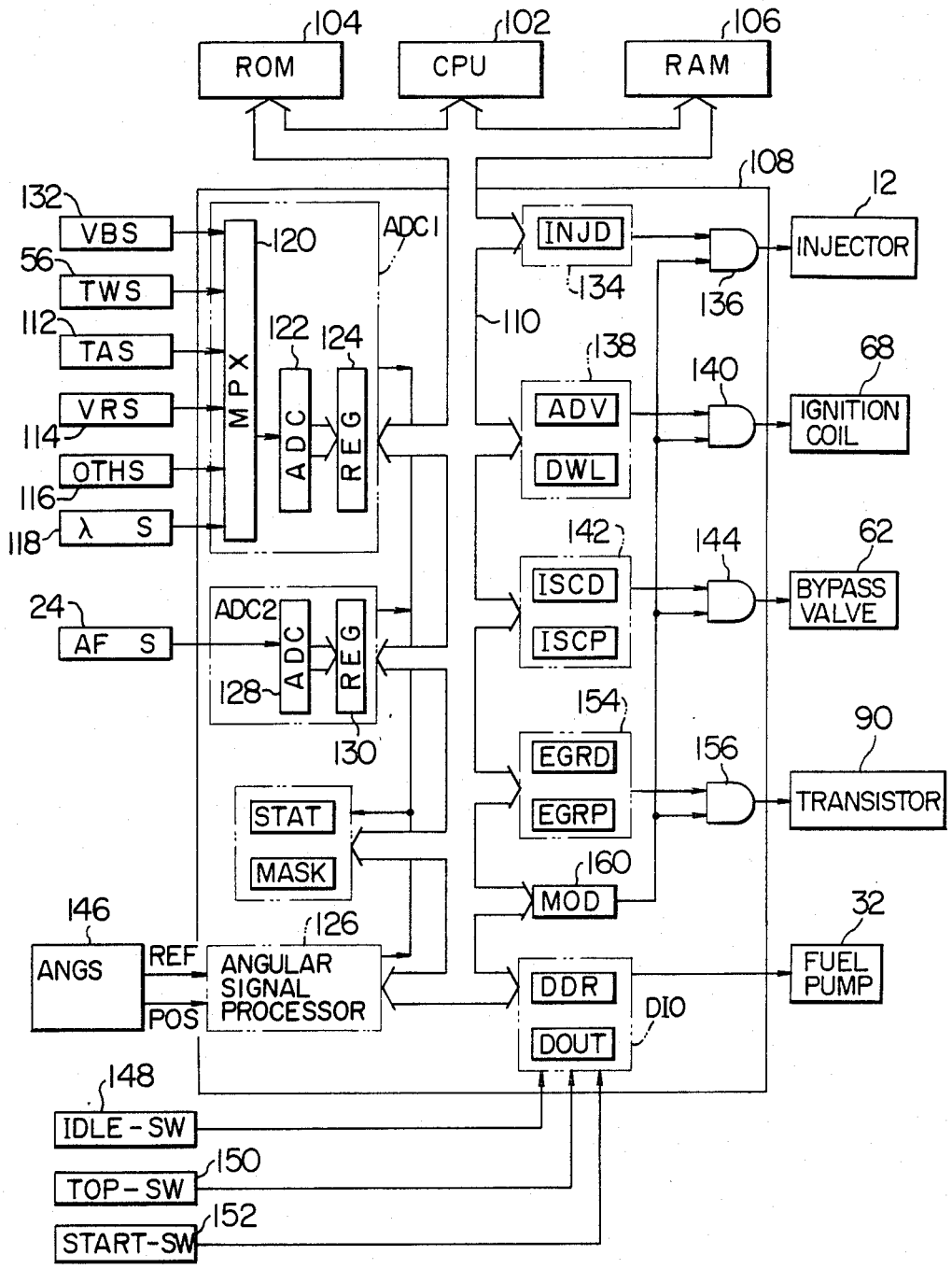
FIG. 5 is a block diagram generally illustrating the engine control system.

Throttle opening sensors (not shown in FIG. 2 but generally represented by a throttle opening sensor 116 in FIG. 5) are respectively provided in the throttle valves 14 and 16 for detecting the opening thereof and the detection signals from these throttle opening sensors, that is the sensor 116, are taken into a multiplexer 120 of a first analog-to-digital converter as shown in FIG. 5.

The fuel to be supplied to the fuel injector 12 is first supplied to a fuel pressure regulator 38 from a fuel tank 30 through a fuel pump 32, a fuel damper 34, and a filter 36. Pressurized fuel is supplied from the fuel pressure regulator 38 to the fuel injector 12 through a pipe 40 and is returned from the fuel pressure regulator 38 to the fuel tank 30 through a return pipe 42 so as to maintain constant the difference between the pressure in the suction pipe 6 into which fuel is injected from the injector 12 and the pressure of the fuel supplied to the injector 12.

The fuel-air mixture sucked through the suction valve 20 is compressed by a piston 50, combusted by a spark produced by an ignition plug 52, and the combustion is converted into kinetic energy. The cylinder 8 is cooled by cooling water 54, the temperature of the cooling water is measured by a water temperature sensor 56, and the measured value is utilized as an engine temperature. A high voltage is applied from an ignition coil 58 to the ignition plug 52 in accordance with the ignition timing.

A crank angle sensor (not shown) for producing a reference angle signal at a regular interval, of predetermined crank angles of, for example, 180 degrees, and a position signal at a regular interval of a predetermined unit crank angle of, for example, 0.5 degrees in accordance with the rotation of engine, is provided on a crank shaft (not shown).

The output of the crank angle sensor, the output 56A of the water temperature sensor 56, and the electrical signal from the heater 24 are inputted into a control circuit 64 constituted by a microcomputer or the like so that the fuel injector 12 and the ignition coil 58 are driven by the output of this control circuit 64.

In the engine system controlled by the arrangement as described above, a bypass 26 bypassing the throttle valve 16 to communicate with the suction pipe 6 is provided and a bypass valve 62 is provided in the bypass 26. A control signal is inputted to a drive section of the bypass valve 62 from the control circuit 64 to control the opening of the bypass valve 62.

That is, the opening of the bypass valve 62 is controlled by a pulse current such that the cross-sectional area of the bypass 26 is changed by the amount of lift of valve which, in turn, is controlled by a drive system driven by the output of the control circuit 64. That is, the control circuit 64 produces an open/close period signal for controlling the drive system so that the drive system responds to this open/close period signal to apply a control signal for controlling the amount of lift of the bypass valve 62 to the drive section of the bypass valve 62.

Figure 3:
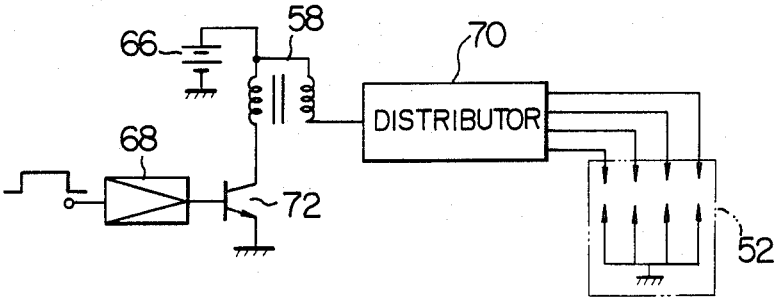
FIG. 3 is a diagram for explaining the ignition device in FIG. 2.

As shown in FIG. 3, a pulse current is supplied to a power transistor 72 through an amplifier 68 to energize this transistor 72 so that a primary coil pulse current flows into an ignition coil 58 from a battery 66. At the trailing edge of this pulse current, the transistor 74 is turned off so as to generate a high voltage at the secondary coil of the ignition coil 58.

This high voltage is distributed through a distributor 70 to ignition plugs 52 provided at the respective cylinders in the engine, in synchronism with the rotation of the engine.

Figure 4:
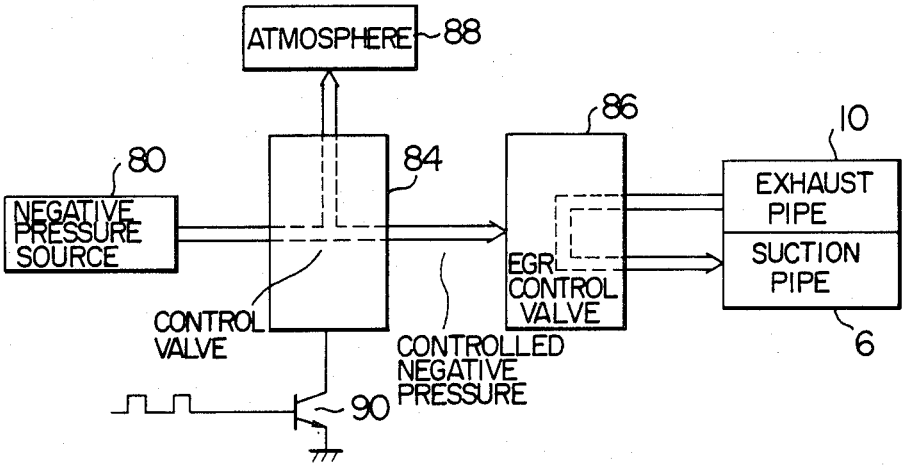
FIG. 4 is a diagram for explaining the exhaust gas recirculation system (EGR)

In FIG. 4, a predetermined negative pressure of a negative pressure source 80 is applied to an EGR control valve 86 through a pressure control valve 84. The pressure control valve 84 controls the ratio with which the predetermined negative pressure of the negative pressure source is released to the atomosphere 88, in response to the ON duty factor of the repetitive pulse applied to a transistor 90, so as to control the state of application of the negative pressure pulse to the EGR control valve 86. Accordingly, the negative pressure applied to the EGR control valve 86 is determined by the ON duty factor of the transistor 90 per se. The amount of EGR from the exhaust pipe 10 to the suction pipe 6 is controlled by the controlled negative pressure of the pressure control valve 84.

As shown in FIG. 5, the control system includes a central processing unit (hereinafter abbreviated as CPU) 102, a read only memory (hereinafter abbreviated as a ROM) 104, a random access memory (hereinafter abbreviated as RAM) 106, and an input/output (hereinafter abbreviated as I/O) circuit 108. The CPU 102 operates input data from the I/O circuit 108 in accordance with various programs stored in the ROM 104 and returns the result of operation to the I/O circuit 108. Temporary data storage necessary for such an operation is performed by using the RAM 106. Exchange of various data among the CPU 102, the ROM 104, the RAM 106, and the I/O circuit 108 is performed through a bus line 110 constituted by a data bus, a control bus, and an address bus.

The I/O circuit 108 includes input means such as the above-mentioned first analog-to-digital converter (hereinafter abbreviated as ADC1), a second analog-to-digital converter (hereinafter abbreviated as (ADC2), an angular signal processing circuit 126, and a discrete I/O circuit (hereinafter abbreviated as DIO) for inputting-/outputting one bit information.

In the ADC1, the respective output signals of a battery voltage sensor (hereinafter abbreviated as VBS) 132, the above-mentioned cooling water temperature sensor (hereinafter abbreviated as TWS) 56, an atmosphere temperature sensor (hereinafter abbreviated as TAS) 112, a regulation voltage generator (hereinafter abbreviated as VRS) 114, the above-mentioned throttle opening sensor (hereinafter referred to as $\theta$THS) 116, and a $\lambda$ sensor (hereinafter abbreviated as $\lambda$S) 118 are applied to the above-mentioned multiplexer 120 (hereinafter abbreviated as MPX) 120 which selects one of the respective input signals and inputs the selected signal to an analog-to-digital converter circuit (hereinafter abbreviated as ADC) 122. The digital value of the output of the ADC 122 is stored in a register (hereinafter abbreviated as REG) 124.

An output signal of an air flow rate sensor (hereinafter abbreviated as AFS) 24 is inputted to the ADC2 in which the signal is A/D converted in an ADC 128 and set in a REG 130.

An angle sensor (hereinafter abbreviated as ANGS) 146 produces a reference signal representing a reference crank angle (hereinafter abbreviated as REF), for example as a signal generated at an interval of 180 degrees of crank angle, and a position signal representing a small crank angle (hereinafter abbreviated as POS), of, for example one degree. The REF and POS are applied to the angular signal processing circuit 126 to be waveform-shaped therein.

The respective output signals of an idle switch 148 (hereinafter abbreviated as IDLE-SW) 148, a top gear switch (hereinafter abbreviated as TOP-SW) 150, and a starter switch 152 (hereinafter abbreviated as START-SW) are inputted into the DIO.

Next, a circuit for outputting pulses in accordance with the result of operation of the CPU 102 and an object to be controlled will be described hereunder. An injector circuit (hereinafter abbreviated as INJC) 134 is provided for converting the digital value of the result of operation into a pulse output. Accordingly, a pulse having a pulse width corresponding to the amount of fuel injection is generated in the INJC 134 and applied to the fuel injector 12 through an AND gate 136.

An ignition pulse generating circuit (hereinafter abbreviated as IGNC) 138 includes a register (hereinafter referred to as ADV) for setting ignition timing and another register (hereinafter referred to as DWL) for setting initiating timing of the primary current conduction of the ignition coil 58 and these data are set by the CPU 102. The ignition pulse generating circuit 138 produces a pulse on the basis of the thus set data and supplies this pulse through an AND gate 140 to the amplifier 68 described in detail with respect to FIG. 3.

The rate of opening of the bypass valve 62 is controlled by a pulse supplied thereto by a control circuit (hereinafter referred to as ISCC) 142 through an AND gate 144. The ISCC 142 has a register ISCD for setting a pulse width and another register ISCP for setting a repetitive pulse period.

An EGR amount controlling pulse generating circuit (hereinafter abbreviated as EGRC) 180 for controlling the transistor 90, which controls the EGR control valve 86 as shown in FIG. 4, has a register EGRD for setting a value representing the duty factor of the pulse and another register EGRP for setting a value representing the repetitive period of the pulse. The output pulse of the EGRC 154 is applied to the transistor 90 through an AND gate 156.

The one-bit I/O signals are controlled by the circuit DIO. The I/O signals include the respective output signals of the IDLE-SW 148, the TOP-SW 150 and the START-SW 152 as input signals, and include a pulse signal for controlling the fuel pump 32 as an output signal. The DIO includes a register DDR for determining whether a terminal be used as a data inputting one or a data outputting one, and another register DOUT for latching the output data.

A register (hereinafter referred to as MOD) 160 is provided for holding commands instructing various internal states of the I/O circuit 108 and arranged such that, for example, all the AND gates 136, 140, 144, and 156 are turned on/off by setting a command into the NOD 160. The stoppage/start of the respective outputs of the INJC 134, IGNC 138, and ISCC 142 can be thus controlled by setting a command into the MOD 160.

Figure 6:
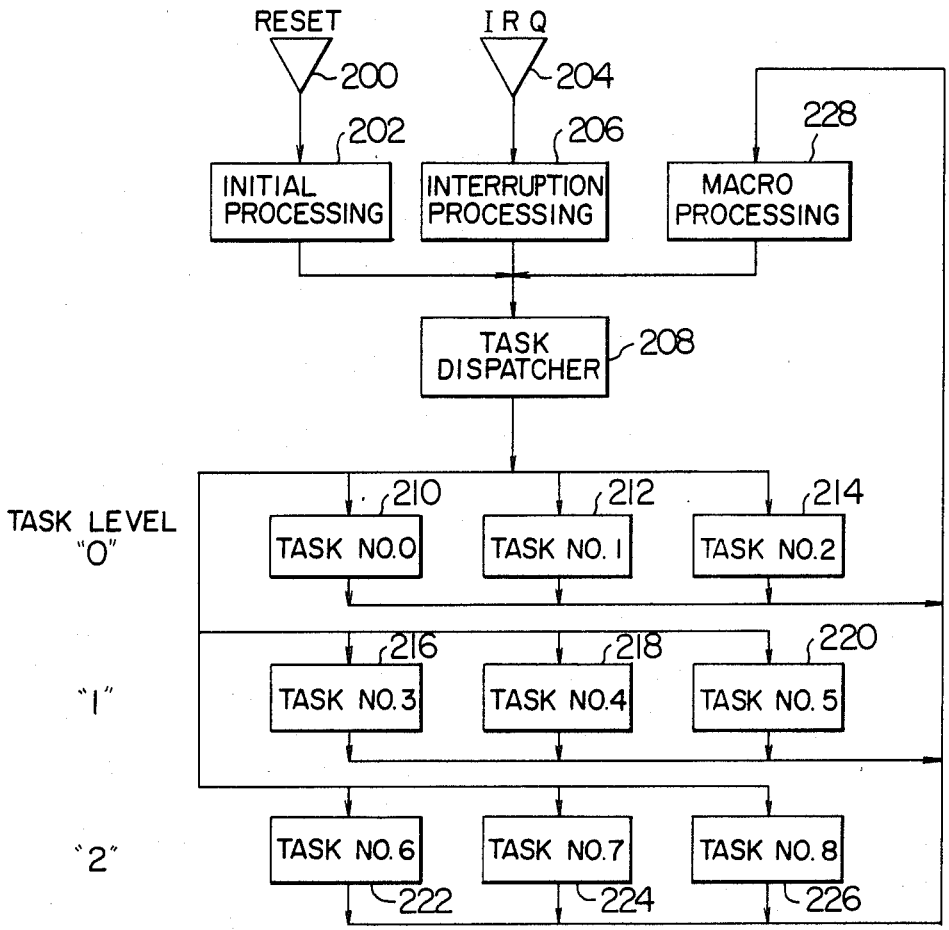
FIG. 6 is a block diagram illustrating the basic construction of the program system for the engine control process according to the present invention.

In FIG. 6, an initial processing program 202, an interruption processing program 206, a macro processing program 228, and a task dispatcher 208 are programs for controlling various tasks. The initial processing program 202 is for executing preprocessing for causing a microcomputer to operate. According to the initial processing program 202, for example, the contents of storage of the RAM 106 is cleared, the initial values of registers in the I/O interface circuit 108 are set, and processing for taking-in data, such as the cooling water temperature Tw, the battery voltage, for performing the preprocessing necessary for performing the engine control is executed. The interruption processing program 206 receives various interruptions, analyzes the factors of the interruptions, and produces a request for causing a desired one of tasks 210 to 226 to the task dispatcher 208. The interruption factors include an A/D conversion interruption (ADC) generated upon the completion of A/D conversion of the input data such as the power source voltage, the cooling water temperature as described later, an initial interruption (INTL) generated in synchronism with the engine revolution, an interval interruption (INTV) generated at a predetermined interval of time, for example every ten msec, an engine stoppage interruption (ENST) generated upon the detection of the engine stoppage, or the like.

Task numbers representing priority are allotted to the tasks 210 to 226, and the respective tasks belong to any one of the task levels "0", "1", and "2". That is, the task Nos. 0 to 2 belong to the task level "0", the task Nos. 3 to 5 belong to the task level "1", and the task Nos. 6 to 8 belong to the task level "2".

Upon the reception of the activation requests by the above-mentioned various interruptions, the task dispatcher 208 responds to the activation requests to allot occupation time onto the CPU 102 to the respective tasks in accordance with the priority rank attached to the respective tasks corresponding to the activation requests.

The task priority control by the task dispatcher 208 is performed by the following method:

(1) The task of low priority rank is interrupted and the displacement of the right of execution to the task of higher priority rank is effected between different task levels. It is assumed here that the task belonging to the level "0" has the highest priority rank;

(2) In the case there is a task which is executing or being interrupted at present in the same task level, the task has the highest priority rank and other tasks can not be operated before the task has been completed; and (3) In the case there are activation requests for a plurality of tasks in the same task levels, a task having a smaller task number has a higher priority rank. In order to perform the above-mentioned priority control, according to the present invention, a soft timer is provided in the RAM 106 for each task and control blocks for controlling tasks are set in the RAM for each task level, while the contents of processing of the task dispatcher 208 will be described later. Every time each of the tasks has been executed, the task dispatcher 208 is informed of the completion of execution of the task by the macro processing program 228.

FIG. 7 shows task blocks of the same number as that of the task levels, that is three in this embodiment since there are three task levels "0" to "2", are provided in the RAM controlled by the dispatcher 208. Eight bits are allotted to each control block. Three of the eight bits, that is 0-th to 2nd bits ($Q_0$–$Q_2$), are the activation bits for performing activation request task indication and the 7-th bit (R) is used for execution bit for indicating whether any one of the same task level is being executed or being interrupted. The activation bits $Q_0$–$Q_2$ are arranged in the order of decreasing the priority rank. For example, the activation bit corresponding to the task No. 4 in FIG. 6 is $Q_0$ in the task level "1". When a task activation request is issued, a flag "1" is set to any one of the activation bits, and at the same time the task dispatcher 208 searches for the issued activation request in the activation bits in the order from the activation bit corresponding to the task of higher level so that the flag corresponding to the issued activation request is reset and flag "1" is set to the execution bit to thereby execute the processing for activating the task corresponding thereto.

FIG. 8 shows an activation address table provided in the RAM 106 controlled by the task dispatcher 208. SA0 to SA8 represent the activation addresses correspond to the task Nos. 0 to 8 of the tasks 210 to 226 as shown in FIG. 6. Sixteen bits are allotted to each activation address information which is used for the task dispatcher 208, as described later, to activate the task corresponding to the issued activation request.

Figure 9:
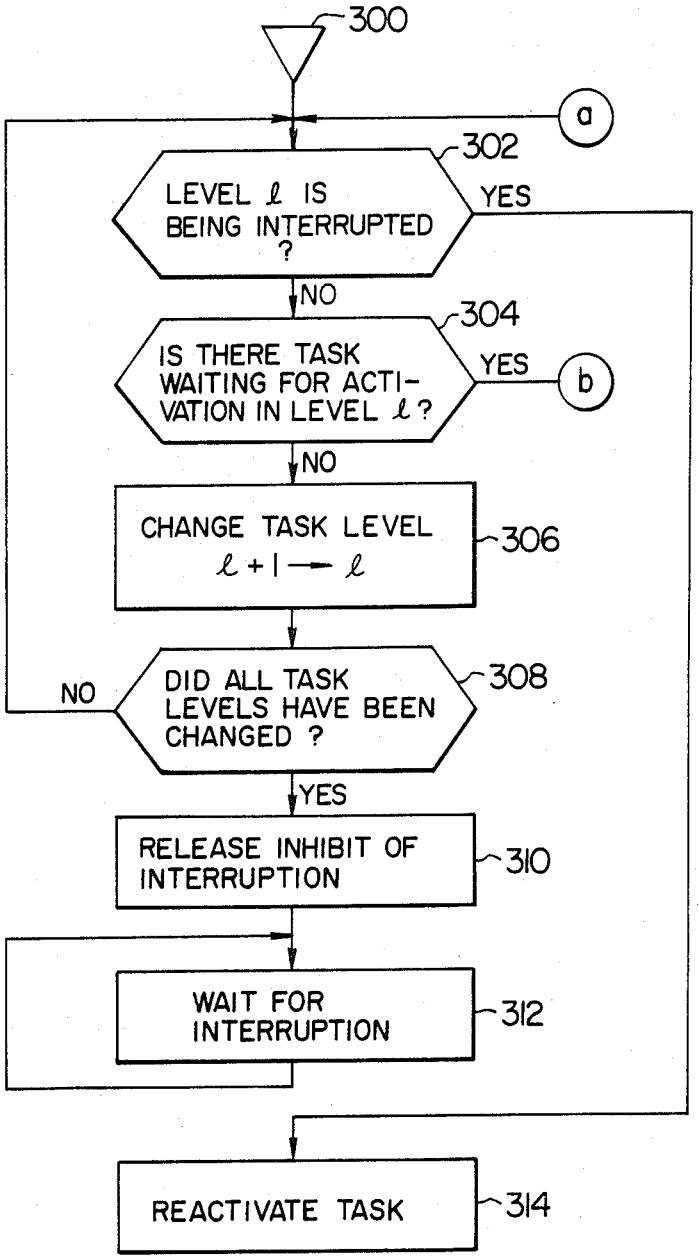
FIGS. 9 and 10 are flowcharts for the processes of the task dispatcher.
Figure 10:
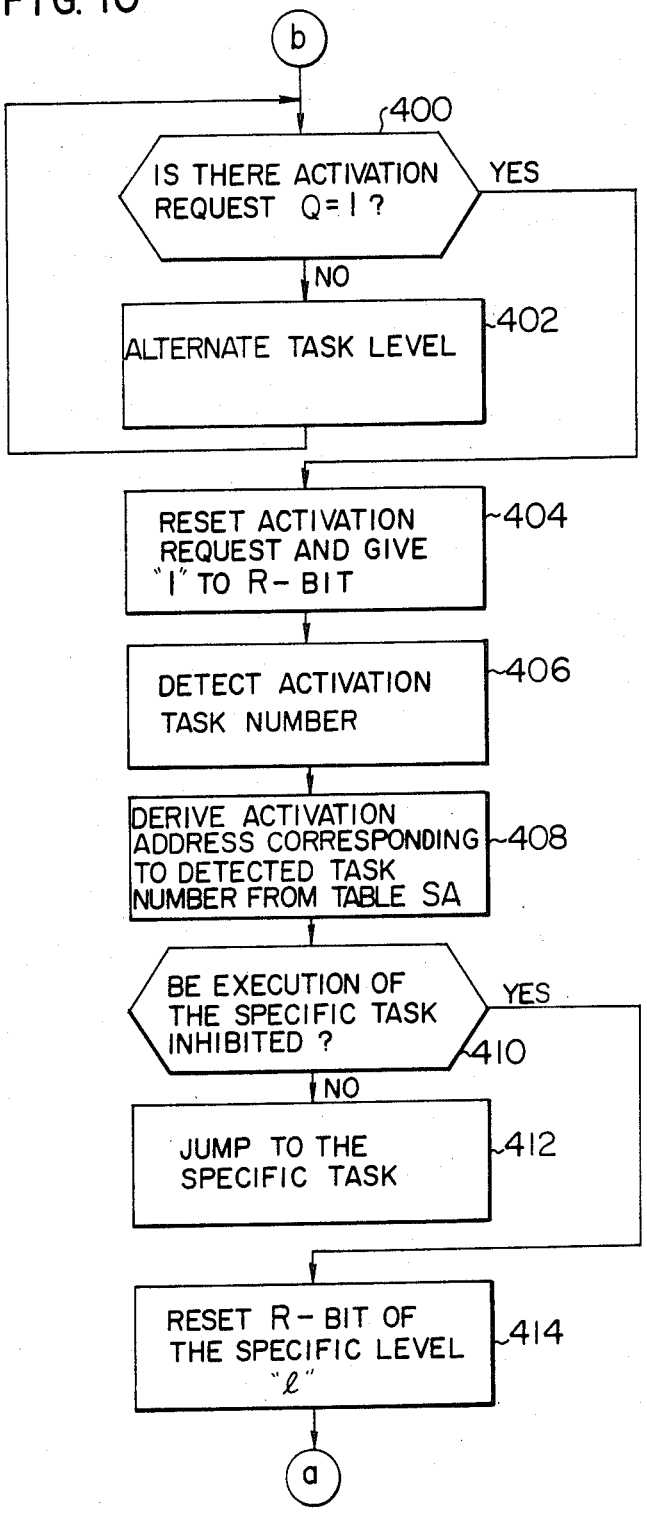

Upon the initiation of the processing by the task dispatcher 208 in a step 300 in FIG. 9, judgement is made as to whether the tasks belonging to the task level l are being executed or interrupted in a step 302. That is, if flag "1" is detected in the execution bit, the flag "1" indicates the state that the macro processing program 228 does not yet issue the task completion information to the task dispatcher 208 and the task which had been executed is being interrupted because interruption of higher priority rank has been generated. Accordingly, if flag "1" is detected in the execution bit, the processing is jumped to a step 314 in which the interrupted task is reactivated.

In the case no flag "1" is detected in the execution bit, on the contrary, that is when the execution indication flag is reset, the processing is shifted to the step 304 in which judgement is made as to whether there is any task waiting for activation in the level l. That is, the activation bits in the level l are searched for in the order of decreasing the priority rank of the tasks corresponding to the activation bits, that is in the order of $Q_0$, $Q_1$ and $Q_2$. If no flag "1 " is detected in any one of the activation bits belonging to the level l, the processing comes to a step 306 in which the task level is altered. That is, the task level l is incremented by +1 so as to be l+1. Upon the alteration of the task level in the step 306, the processing comes to a step 308 in which judgement is made as to whether all the task levels have been checked. In the case where all the task levels have been not yet checked, that is, when l=2 in this embodiment, the processing comes back to the step 302 and the above-mentioned processing is repeated. In the case where the result of judgement proves that all the task levels have been checked in the step 308, the processing comes to a step 310 in which inhibit to interruption is released because interruption has been inhibited during the processing in the steps 302 to 308. Thereafter, in the next step 312, next issued interruption is awaited.

If there is a task waiting for activation in the level l in the step 304, that is if flag "1" is detected in one of the activation bits belonging to the task level l, the processing comes to a step 400. In the loop constituted by the step 400 and the next step 402, search is made as to which one of the activation bits in which one of the task levels is provided with flag "1", in the order of decreasing the priority rank of the task levels, that is in the order of $Q_0$, $Q_1$, and $Q_2$. When the activation bit provided with flag "1" is detected, the processing comes to a step 404 in which the activation bit provided with flag "1" is reset and flag "1" is set to the execution bit (hereinafter referred to R) of the same task level. In a step 406, the number of the activated task is detected, and in a step 408, the activation address information as to the activated task is derived in accordance with the activation address table provided in the RAM as shown in FIG. 8.

In a step 410, judgement is made as to whether the activated task be executed or not. In this case, the necessity of the execution is judged on the basis of the value of the activation address information. That is, when the activation address information has a specific value, for example "0", the judgement is such that the execution is not necessary. It is necessary to provide this judgement step in order to cause a motor vehicle to have a function of performing only a specific one of the task functions for performing engine control selected depending on the kind of the motor vehicle. When judgement is made in the step 410 such that the execution of the specific task is stopped, the processing comes to a step 414 in which the R-bit of the specific task level l is reset. Then, the processing comes back to the step 302 in which judgement is made as to whether the task level l is being interrupted or not. This is because there may be a case where a plurality of activation bits are provided with flag "1".

In the case where the execution of the specific task is not inhibited, that is when the specific task be executed, the processing comes to a step 412 in which jump is made to the specific task so as to execute the task.

Figure 11:
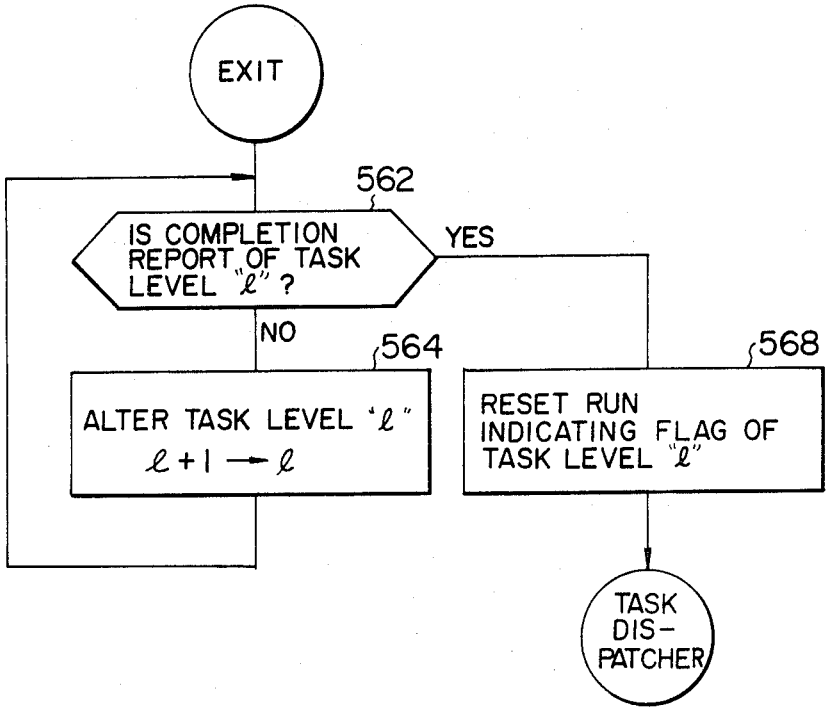
FIG. 11 is a flowchart for executing a macro processing program.

As shown in FIG. 11, the macro processing program 228 is constituted by steps 562 and 564 wherein the task levels are searched in the order of increasing the task level, that is in the order from the level "0" so as to find completed task level or levels. Then the processing comes to a step 568 in which the execution (RUN) flag provided in the 7th bit in the task control block of the completed task is reset. Thus, the execution of the task has been completed. Then, the processing comes back to the task dispatcher 208 in which the next execution task is determined.

Figure 12:
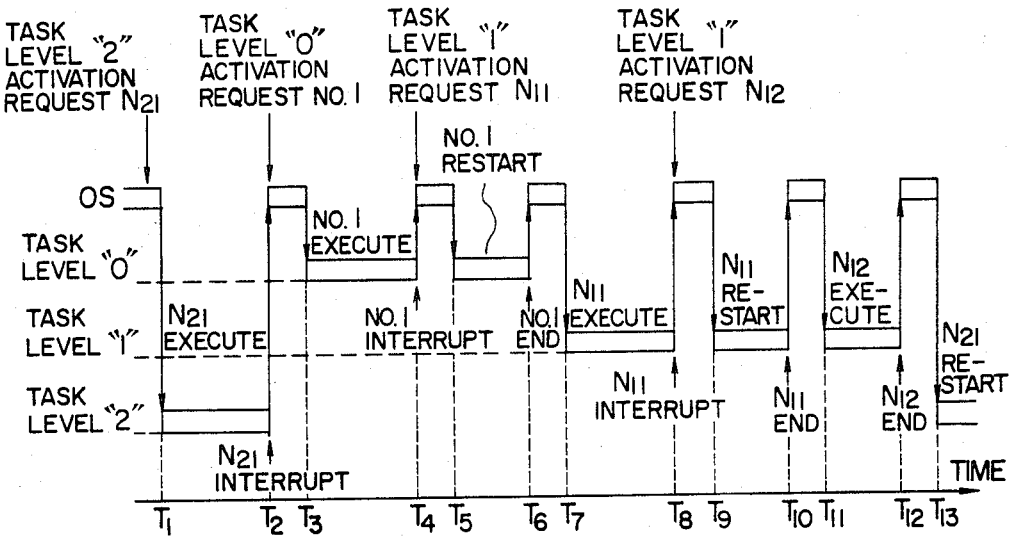
FIG. 12 is a diagram showing an example of task priority control.

Referring to FIG. 12, the execution and interruption of task will be explained as to the case where the task priority control is performed by the task dispatcher 208. Assume that in the activation request $N_{mn}$, m represents the task level and n represents the rank of priority in the task level m, and that the CPU is executing the control program OS. Then, when an activation request $N_{21}$ is generated in executing this control program OS, the execution of the task corresponding to the activation request $N_{21}$, that is, the execution of the task No. 6, is initiated at the time $T_1$. If another activation request $N_{01}$ for the task having a higher execution priority rank is issued at the time $T_2$ in executing the task No. 6, the execution is shifted to the control program OS and after predetermined processing has been performed as already described, the execution of the task corresponding to the activation request $N_{01}$, that is, the execution of the task No. 0, is initiated at the time $T_3$. When a further activation request $N_{11}$ is issued at the Time $T_4$ in executing the task No. 0, the execution is once shifted to the control program OS and after a predetermined processing has been executed, the execution of the task No. 0 which has been so far interrupted is restarted at the time $T_5$. When the execution of the task No. 0 is completed at the time $T_6$, the execution is shifted again to the control program OS, the completion of execution of the task No. 0 is reported by the macro processing program 228 to the task dispatcher 208, and then the execution of the task No. 3 which corresponds to the activation request $N_{11}$ and which has been so far waiting for reactivation is initiated at the time $T_7$. When an activation request $N_{12}$ having a lower priority rank in the same task level "1" is issued at the time $T_8$ in executing the task No. 3, the execution of the task No. 3 is once interrupted, the execution is once shifted to the control program OS, and after a predetermined processing has been performed, the execution of the task No. 3 is restarted at the time $T_9$. Upon the completion of the execution of the task No. 3 at the time $T_{10}$, the execution of the CPU is shifted to the control program OS, the completion of execution of the task No. 3 is reported by the macro program 228 to the task dispatcher 208, the execution of the task No. 4 corresponding to the activation request $N_{12}$ of lower priority rank is initiated at the time $T_{11}$, the execution is shifted to the control program OS upon the completion of execution of the task No. 4 at the time $T_{12}$, and after a predetermined processing has been performed the execution of the task No. 6 which corresponds to the activation request $N_{21}$ and which has been so far interrupted is restarted at the time $T_{13}$.

The task priority control is performed in the manner as described above.

Figure 13:
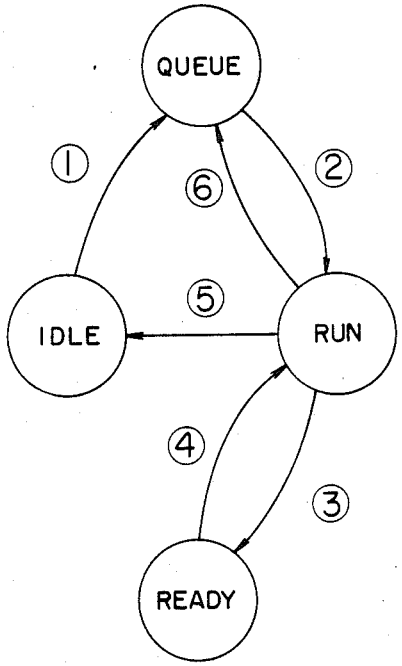
FIG. 13 is a diagram showing the transition of state of the task in the above-mentioned task priority control.

The state of transition in the task priority control is illustrated in FIG. 13 "Idle" represents the state in which activation is awaited and no task activation request has been issued. Then, if an activation request is issued, flag "1" is set to the activation bit of the task control block so as to indicate the necessity of activation. The time required for shifting from the state "Idle" to the state "Queue" is determined by the level of the respective task. In the state "Queue", the order of execution is determined on the basis of the rank of priority. The specific task is brought into the state of execution after the flag of the activation bit of the task control block has been reset by the task dispatcher 208 in accordance with the control program OS and a flag "1" has been set to the R-bit (7th bit). Thus, the execution of task is initiated. This is the state "Run". Upon the completion of execution, the flag of the R-bit of the task control block is cleared and the completion report is terminated. Thus, the state "Run" ends and the state "Idle" is recovered to wait for the issuance of the next activation request. If an interruption request IRQ is generated in executing a task, that is, in the state "Run", the execution of the task has to be interrupted. For this, the contents of the CPU is shunted and the execution is interrupted. This state is "Ready". Next, when the state in which the task is to be executed is recovered, the shunted contents is returned back to the CPU and execution is restarted. That is, the state "Run" is recovered from the state "Ready". Thus, the respective level program repeates the four states of FIG. 13. FIG. 13 shows a typical flow. However, there may be a case where a flag "1" is set to the activation bit of the task control block in the state "Ready". This is the case, for example, in the state of interruption of activation of a task, the next activation request timing of the task is reached. In this case the flag in the R-bit takes preference and the task which is being interrupted is terminated. Thus, the flag in the R-bit is cleared and the state becomes "Queue" bypassing the state "Idle" due to the flag in the activation bit. Thus, each of the tasks Nos. 0 to 7 is in any one of the four states of FIG. 13.

Figure 14:
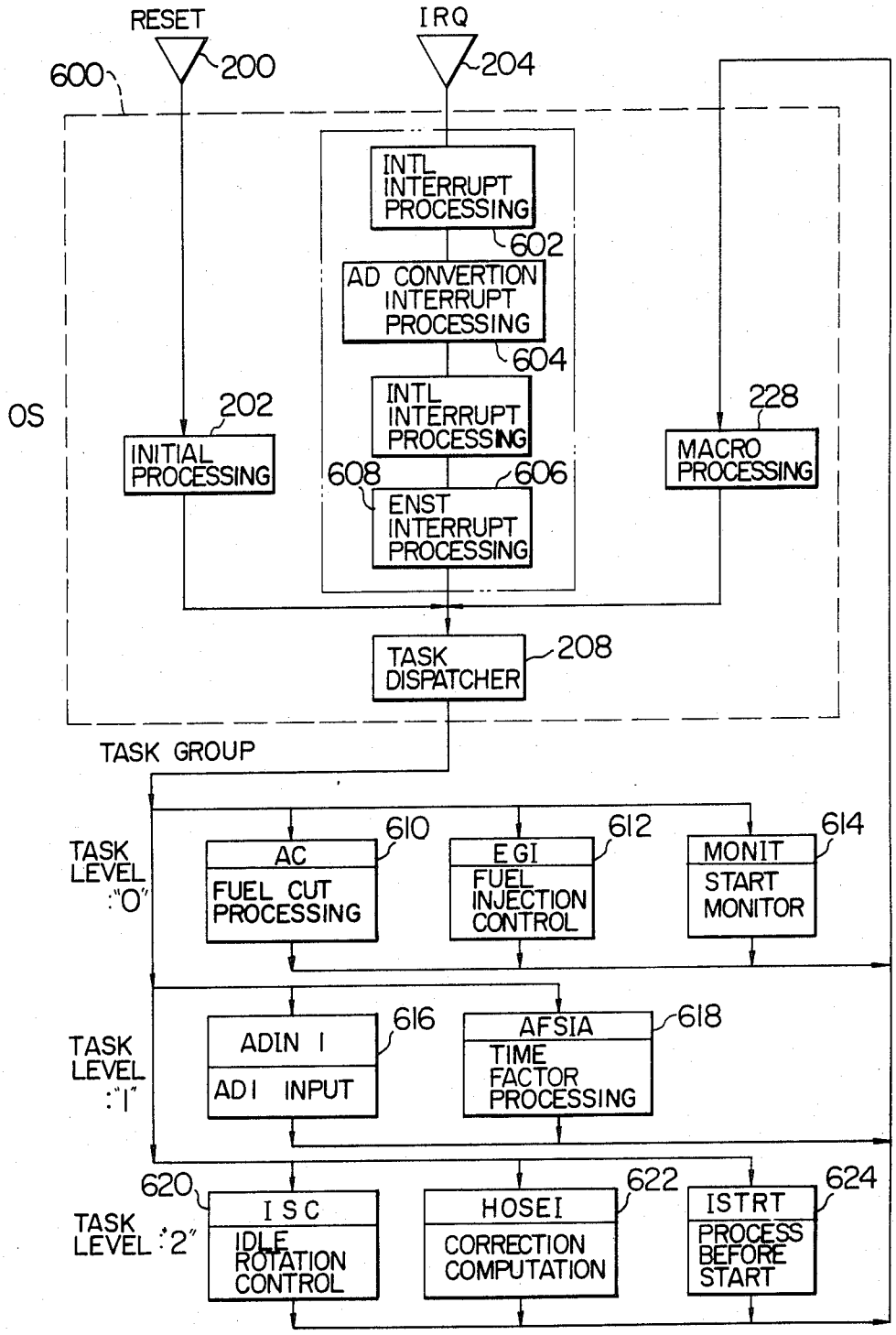
FIG. 14 is a particular flowchart in FIG. 6.

In FIG. 14, a control program OS includes an initial processing program 202, an interruption processing program 206, a task dispatcher 208, and a macro processing program 228.

The interruption program 206 includes various kinds of interruption processing programs in which an initial interruption processing (hereinafter referred to as an INTL interruption processing) 602 generates initial interruptions in the number of half the number of the engine cylinders per revolution, for example, twice per revolution in the case of four cylinders, due to an initial interruption signal generated in synchronism with the engine revolution. The date indicative of the fuel injection timing computed by an EGI task 612 in response to the above-mentioned INTL interruption is set in a register INJD in the INJC 134 included in the I/O interface circuit 108 (FIG. 5). An A/D conversion interruption processing 604 includes two kinds of interruption, that is, an ADC1 (FIG. 5) interruption and an ADC2 (FIG. 5) interruption. The ADC1 (FIG. 5) has the accuracy of 8 bits, and is used for inputting data such as the battery voltage, the cooling water temperature, the suction air temperature, the regulated voltage, etc., applied thereto. The ADC1 starts the A/D conversion as soon as the input point to the MPX 120 (FIG. 5) is assigned, and issues the ADC1 interruption upon the completion of the A/D conversion. The ADC1 interruption is used only before cranking. The ADC 128 in the ADC2 (FIG. 5) is used for inputting the data indicative of the air flow rate and generates the ADC2 interruption immediately after the A/D conversion. The ADC2 interruption is also used only before cranking.

In an interval (hereinafter abbreviated as INTV) interruption processing program 606, an INTV interruption signal is generated at a time interval of a predetermined time of, for example, ten msec set in an INTV register (not shown) and is used as a basic signal for monitoring the activating timing of tasks to be activated at a predetermined interval of time. This INTV interruption signal updates the soft timer thereby activating the mask now ready to be activated. In an engine stoppage task (hereinafter referred to as an ENST task) interruption processing program 608 is for detecting state of ENST and starts counting in response to the detection of an INTL interruption signal so as to issue an ENST interruption when no INTL interruption signal can not be detected within a predetermined period of time of, for example, one sec. When the ENST interruption is issued three times, that is, when no INTL interruption can be detected within a period of time of, for example, three sec, the engine is judged as having stopped, and energization of the ignition coil 58 and operation of the fuel pump 32 are stopped. After execution of these processing steps, the microcomputer stands by until the START-SW 152 is turned on. Table 1 shows the outline of processing executed in response to the interruption signals described above.

TABLE 1

| Interrupt | Outline of processing |
|---|---|
| INTL | Ignition timing is set in INJD in INJC 134. |
| ADC1 | Task ADIN1 is activated. |
| ADC2 | Air flow-rate signal processing task AC is activated. |
| INTV | Activating timings of tasks ADIN2, EGI, MONIT, ADIN1, AFSIA and ISC to be activated at predetermined periods are checked to activate the task now ready to be activated. |
| ENST | ENST interrupt processing is executed to initialize the system. |

As to the INTL processing program 202 and the macro processing program 228, the processing steps are performed in the manner as described above.

The following tasks are activated in response to the various interruptions as described above. Tasks belonging to the task level "0" include a fuel cutting processing task (hereinafter referred to as an AC task), a fuel injection control task (hereinafter referred to as an EGI task), and a starting timing monitoring task (hereinafter referred to as an MONIT task). Tasks belonging to the task level "1" include an AD1 input task (hereinafter referred to as an ADIN1 task) and a time coefficient processing task (hereinafter referred to as an AFCIA task). Tasks belonging to the task level "2" include an idling rotation control task (hereinafter referred to as an ISC task), a compensation computation task (hereinafter referred to as an HOSEI task), and a pre-starting processing task (hereinafter referred to as an INSTRT task).

Table 2 shows the allocation of the task levels and the functions of the individual tasks.

TABLE 2

| Level | Program | Task No. | Function | Activation period |
|---|---|---|---|---|
| 0 | OS | INTL | Engine-rotation-interruption control | At LEAST 5 msec |
| 1 | | | Other OS processing | |
| 0 | AC | 0 | Fuel Cutting | 10 msec |
| | EGI | 1 | Adjustment of integration flow-rate reference level | 20 msec |
| | MONIT | 3 | Monitoring of START-SW (OFF), control of fuel injection time in starting stage, start-stop of soft timers | 40 msec |
| 1 | ADIN1 | 4 | Correction and filtering of inputs to ADC 122 | 50 msec |
| | AFSIA | 6 | Control of after-starting, after-idling and after-acceleration time factors | 120 msec |
| 2 | ISC | 8 | Idling rotation speed control | 160 msec |
| | HOSEI | 9 | Compensation factor computation | 300 msec |
| | ISTRT | 11 | Computation of EGI initial value, monitoring of START-SW (ON), start-stop of soft timers, starting of fuel pump, starting of I/O LSI | 30 msec |

As will be apparent from Table 2, the activation periods of the individual tasks activated in response to the various interruptions are previously determined, and this information is stored in the ROM 104.

Figure 15:
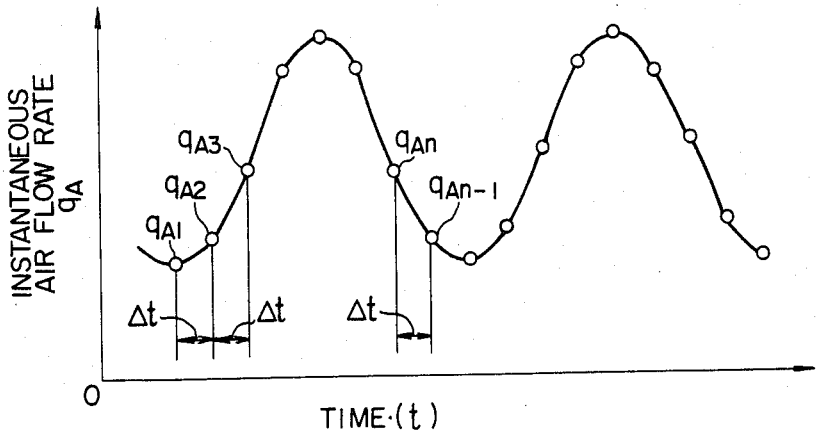
FIG. 15 is a diagram showing the timing for taking-in the hot-wire output voltage.

Discription will now be directed as to the processing of the output signal from the hot-wire type flow rate sensor and the fuel injection control. FIG. 15 shows the manner of processing of the output signal from the hot-wire type flow rate sensor employed in the present invention. The instantaneous air flow rate $q_A$ can be computed from the hot-wire sensor output voltage v from the equation (5). Since the instantaneous air flow rate $q_A$ is an instantaneous value in the pulsating state as shown in FIG. 15, it is sampled at a predetermined time interval $\Delta t$. The mean air flow rate $Q_A$ can be computed from the respective sampled values of the instantaneous air flow rate $Q_A$ according to the following equation:

$$q_A = \frac{q_{A1} \cdot \Delta t + q_{A2} \cdot \Delta t + \ldots + q_{An} \cdot \Delta t}{n \cdot \Delta t} = \frac{\sum_{n=1}^{n} q_{An}}{n} \quad (8)$$

Thus, the air flow rate drawn into the cylinder can be obtained as $$\sum_{n=1}^{n} q_{An}$$

from the equation (8). Thus, the integrated air flow rate can be obtained by the above-mentioned signal processing.

According to the present invention, the fuel injection may be performed in such a manner that the amount of fuel injected per revolution of the engine is computed on the basis of the equation (7), to thereby perform fuel injection once per one suction stroke in each cylinder, for example, once every 180° rotation of the crank in the case of engine provided with 4 cylinders. Alternatively, the fuel injection may be performed when the integrated air flow rate actual value attains a given level. Although an embodiment in which the present invention is applied to the latter fuel injection system, the present invention can be applied to the former one.

Figure 16:
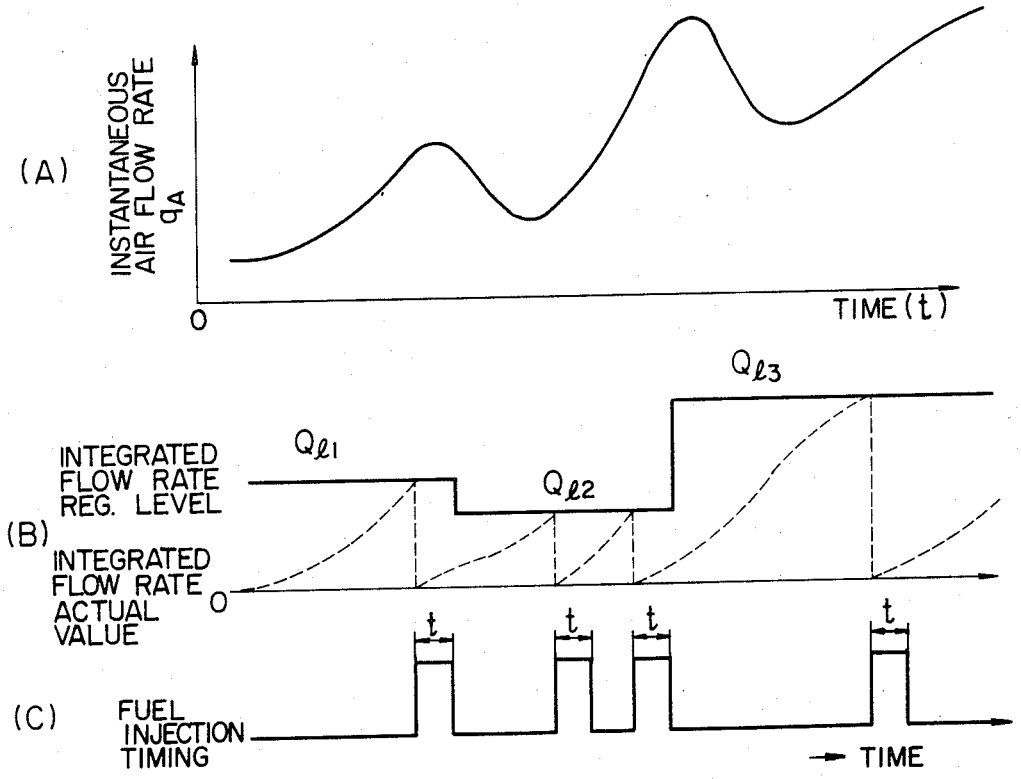

FIG. 16 shows the timing of fuel injection according to the above-mentioned latter fuel injection system. The instantaneous air flow rate $q_A$ is integrated for a predetermined period of time, and, when the integrated air flow rate actual value attains or exceeds an integrated air flow rate reference level $Q_l$, fuel is injected for a predetermined period of time t as seen in FIG. 16. That is, fuel is injected at the timing at which the integrated instantaneous air flow rate actual value has attained the integrated air flow rate reference level $Q_l$. In FIG. 16, there are shown three integrated air flow rate reference levels $Q_{l1}$, $Q_{l2}$ and $Q_{l3}$. When the integrated air flow rate reference level is shifted from $Q_{l1}$ to $Q_{l2}$, the fuel-air mixture becomes richer, while when it is shifted from $Q_2$ to $Q_3$, the fuel-air mixture becomes leaner. According to this system, the integrated air flow rate reference value $Q_l$ is suitably shifted so as to adjust the air-fuel ratio (A/F) as described. A rich fuel-air mixture is required during warming-up in the engine starting stage, and this can be achieved by reducing the integrated air flow rate reference level $Q_l$. For the optimized control of the air-fuel ratio, the integrated air flow rate reference level $Q_l$ can be suitably adjusted by the ON-OFF of the output from an $O_2$ sensor (not shown).

Referring to FIG. 17, judgement is made in a step 801 as to whether the interruption is an INTL interruption or not. When the result of judgement in the step 801 proves that the interruption is an INTL one, the ADV REG in IGNC 138 is set so as to complete the INTL interruption processing program. When the result of judgement in the step 801 proves, on the contrary, that the interruption is not the INTL one, judgement is made in a step 805 as to whether the interruption is the $Q_A$ timer interruption or not. When the result of judgement in the step 801 proves that the interruption is a $Q_A$ timer interruption, activation is made for taking-in the output of the hot-wire type flow rate sensor in a step 806, and taking-in of the output of the hot-wire type flow rate sensor is performed in a step 807. The instantaneous air flow rate $q_A$ as shown in the equation (5) is computed in a step 808 and the integration processing is performed in a step 809. Judgement is made in a step 810 as to whether the integrated value of instantaneous air flow rate has reached the integrated air flow rate reference level. When the result of judgement in the step 810 proves that the integrated air flow rate reference level has been reached, a period of time of fuel injection t corresponding to the integrated air flow rate reference level is set in a step 811 into the INJD REG of INJC 134 (FIG. 5), and basic injection pulse is produced in a step 812 from the INJD REG of INJC 134 to the injector 12 through the AND gate 136 to initiate the injection with the basic fuel amount $T_P$. At this time, the width of the basic injection pulse is determined by the period of time t for injection, and the amount of basic fuel injection $T_P$ is determined by the integrated air flow rate reference level. In a step 813, the difference between the integrated air flow rate actual value and the integrated air flow rate reference level is computed to regard it as the present integrated air flow rate. When the result of judgement in the step 805 proves that the interruption is not a $Q_A$ timer interruption, judgement is made in a step 815 as to whether the interruption is an ADC interruption or not. When the result of judgement in the step 815 proves that it is an ADC one, judgement is made in a step 816 as to whether or not the IST flag is in the state "1". When the result of judgement in the step 816 is "YES", the hot-wire type flow rate sensor is activated and the output of the same is taken-in in a step 817. The thus taken-in value of the air flow rate is used for detection of the engine start due to rotation torque of wheels. When the result of judgement in the step 815 proves that the interruption is not an ADC one, as well as when the result of judgement in the step 816 is "NO", the processing is shifted to the INTV interruption processing 606 in FIG. 14.

FIG. 18 shows the relation between the temperature TW of engine cooling water sensed by the cooling water temperature sensor 56 and the air flow rate reference level. That is, FIG. 18 shows how the reference level is varied relative to the output signal of the water temperature sensor 56. The temperature range of from −40° C. to 40° C. corresponds to the warming-up level in which the engine is started from its cold state. The temperature range from 40° C. to 85° C. corresponds to the normal starting level, and the temperature range higher than 85° C. corresponds to the hot re-starting level. As soon as the engine key is turned on to start the engine, the sensor output signal, indicative of the temperature of the engine cooling water, is taken into to the ADC1 so that the air amount reference level corresponding to the sensed temperature can be set by comparison according to the relation shown in FIG. 18. The INTST program 624 shown in FIG. 14 is executed for the purpose.

The processing in rapid acceleration/deceleration in engine running will be described by using the flowchart as shown in FIG. 19. In the step 901, first, the hot-wire output signal representing the air flow rate is integrated for a predetermined period of time and the integrated value is stored in the RAM. In the step 902, then, the hot-wire output is integrated for the predetermined period of time to obtain new integrated value of air flow rate $Q_{A(NEW)}$ and the difference $\Delta Q_A = Q_{A(NEW)} - Q_{A(OLD)}$ between the new integrated value of air flow rate $Q_{A(NEW)}$ and the old integrated value of air flow rate $Q_{A(OLD)}$ obtained in the step 901 is computed. In the step 903, next, judgement is made as to whether the difference value $\Delta Q_A$ obtained in the step 902 is larger than a predetermined positive value or not, that is, as to whether the state is rapid acceleration or not. If the result of judgement proves that the state is rapid acceleration, the rapid acceleration injection period of time is computed on the basis of the value $\Delta Q_A$, and in the step 904, then, judgement is made as to whether fuel is being injected by the fuel injector 12 or not. If the result of judgement in the step 903 proves, on the contrary, that the state is not rapid acceleration, further judgement is made in the step 905 as to whether the difference value $\Delta Q_A$ obtained in the step 902 is smaller than a predetermined negative value or not, that is, as to whether the state is rapid deceleration or not. In the result of judgement in the step 904 proves that the fuel is being injected, the acceleration injection period of time obtained in the step 903 is added in the step 906 to the data in the INJD register 134, that is, to the residual injection period of time and the fuel injection is continued. If the result of judgement in the step 904 proves, on the contrary, that fuel injection is not being performed, the acceleration injection period of time obtained in the step 903 is set in the INJD register 134 in the step 907 and fuel injection is initiated.

If the result of judgement proves that the state is not rapid deceleration in the step 905, no processing is performed, while if it proves that the state is rapid deceleration, the injection pulse applied to the fuel injector 134 is stopped to cut off the fuel injection.

Alternatively, in the steps 901 and 902, the rate of change of the opening of the throttle valve for a predetermined period of time may be obtained to perform the judgment as to whether the state is rapid acceleration or rapid deceleration on the basis of the obtained rate of change.

FIG. 20 shows a soft timer table which is provided in the RAM 106 and which is provided with timer blocks in the same number as that of different activation periods activated by various kinds of interruptions. The term "timer block" is defined as a storage area into which time information with respect to the activation period of the task stored in the ROM 104. In FIG. 20, "TMB" described at the left end represents the head address of the soft timer table in the RAM 106. Into each of the timer blocks of the soft timer table, the time information with respect to the above-mentioned activation period is stored from the ROM 104 in starting the engine. That is, when the INTV interruption is performed, for example, at a regular period of time of ten msec, a value which is integral multiples of ten msec and which represents the respective activation period is transferred and stored in the respective timer block.

In FIG. 21, if the program is activated at a step 626, the soft timer table provided in the RAM 106 is initialized in a step 628. That is, the contents i of the index register is made 0 (zero) and the residual time $T_1$ stored in the timer block of the address TMB+0 in the timer table is checked. In this case $T_1 = T_0$. Next, judgement is made in a step 630 as to whether the soft timer checked in the step 628 is in the state of stoppage or not. That is, when the residual time $T_1$ stored in the soft timer table is 0 (zero), the judgement is concluded that the soft timer is in the state of stoppage and that the corresponding task to be activated by the specific soft timer is in the state of stoppage, so that processing is jumped to a step 640 in which the soft timer table is renewed. That is, the above-mentioned judgement is made on the basis of the fact that when the task is stopped, the residual timer is left it as it is without being initialized when it becomes 0 (zero).

In the case where the residual timer $T_1 \neq 0$, the processing is shifted to a step 632 in which the residual timer in the time block is renewed. In particular, the residual timer $T_1$ is decreased by 1 (one). Next, judgement is made in a step 634 as to whether the soft timer has reached the activation period or not. When the residual timer $T_1 = 0$, the judgement is concluded that the activation period has been reached and the processing is shifted to a step 636. If the judgement is concluded that the soft timer has not reached the activation period, on the contrary, the processing is jumped to the step 640 in which the soft timer table is renewed. When the soft timer table has reached the activation period, the residual time $T_1$ of the soft timer table is initialized in the step 636. That is, the timer information with respect to the activation period of the specific task is transferred from the ROM 104 to the RAM 106. After the residual timer $T_1$ of the soft timer table has been initialized in the step 636, an activation request for the task corresponding to the soft timer table is issued in a step 638. Then, the soft timer table is renewed in the step 640. That is, the contents of the soft timer table is incremented by 1 (one). Further judgement is made in a step 642 as to whether all the soft timers have been checked or not. That is, since (n+1) soft timer tables are provided in this embodiment as seen in FIG. 21, the judgement is concluded that all the soft timer tables have checked when the contents i of the index register is $i=n+1$ and the INTV interruption processing program 606 is terminated in a step 644. When the judgement is concluded in the step 642 that not all the soft timer tables has been checked, on the contrary, the processing is returned back to the step 630 so that the above-mentioned processings are performed.

As described above, in accordance with various kinds of interruptions activation requests for specific tasks corresponding to the interruptions are issued and the specific tasks are executed in response to the activation requests. However, all the tasks listed up in Table 2 are not always executed, but pieces of time information with respect to actrivation periods of the respective tasks provided in the ROM 104 are selected on the basis of the running information as to the engine and the selected time information is stored in the RAM 106. Assuming that the activation period of a given task is, for example twenty msec, the task is activated at the regular period of time of twenty msec, and, if the activation of the task is necessary to be continuously effected in accordance with the running condition of engine, the soft timer table corresponding to the specific task is always renewed so as to be initialized.

Next, the status in which the activation of tasks is stopped due to various interruptions in accordance with the running condition of the engine will be described by referring to the time chart of FIG. 22. Upon the actuation of the START-SW 152 (FIG. 5), the CPU 102 is actuated and "1" is set to each of software flags IST and EM. The software flag IST is provided for indicating that the engine is in its pre-starting state and the software flag EM is provided for the inhibition of ENST interruption. In accordance with these two flags, judgement is made as to whether the engine is in its pre-starting state, in its starting state, or in its post-starting state. When the START-SW 152 is actuated to turn on power, the task ADIN1 is first activated so that the data, such as the cooling water temperature, the battery voltage, necessary for the starting of the engine are taken from the various sensors into the ADC 122 through the MPX 120, and every time all these data have been successively inputted, the task HOSEI, that is, the compensation task, is activated so that compensation is computed on the basis of the inputted data. Further, every time all the data from the various sensors have been successively inputted to the ADC 122 in accordance with the ADIN1, the task ISTRT is activated so that the fuel injection amount necessary in starting of the engine is computed. The above-mentioned three tasks, that is, the task ADIN1, the task HOSEI and the task ISTRT are activated in accordance with the initial processing program 202.

Upon the turning ON of the START-SW 152, the three tasks, that is, the task ADIN1, the task HOSEI and the task ISTRT are activated by the interruption signal of the task ISTRT. That is, these tasks have to be executed only in the period in which the START-SW 152 is in its ON state (in the period of cranking of the engine). In this period, pieces of time information with respect to the predetermined activation periods are transferred from the ROM 104 to the soft timer tables corresponding to the respective tasks provided in the RAM 106. Further, in this period, the residual time $T_1$ in the respective soft timer table is initialized and the setting of activation period is repeatedly performed. Being provided for computing the fuel injection amount in the starting of the engine, the task MONIT becomes unnecessary after the engine starting, and, therefore, after the task has been executed predetermined number of times, the activation of the soft timer is stopped and tasks necessary in the post-starting state of the engine other than the task MONIT are activated in response to a stoppage signal produced upon the termination of the task MONIT. In order to perform the stoppage of the task by the soft timer "0" is stored in the soft timer table corresponding to the task in response to a signal indicating the termination of the task at the judgement point of time at the end of the task. That is, the stoppage of task is effected by clearing the contents of the soft timer corresponding to the task. Thus arrangement is made such that the stoppage of task activation can be simply attained by the soft timer and therefore a plurality of tasks having different activation periods from each other can be controlled effectively and reliably.

As shown in FIG. 23 an INTV IRQ generating circuit includes a register 735, a counter 736, a comparator 737, and a flip-flop 738, and a period for generating INTV IRQ, for example ten msec, is set into the register 735. A clock pulse is set into the counter 736, and when the count of the counter 736 becomes coincident with the contents of the register 735, the flip-flop 738 is set. In this set state of the flip-flop 738, the counter 738 is cleared and the counting is restarted. Therefore, the INTV IRQ is generated at a predetermined regular interval of time (ten msec). An ENST IRQ generating circuit for detecting engine stoppage is constituted by a register 741, a counter 742, a comparator 743, and a flip-flop 744. The register 741, the counter 742 and the comparator 743 operate in the same manner as described above in the INTV IRQ generating circuit so that when the count of the counter 742 has reached the contents of the register 741, an ENST IRQ is generated. However, since the counter 742 is cleared by an REF pulse generated by a crank angle sensor at a predetermined interval of crank angles during the rotation of engine, the count of the counter 742 can not reach the contents of the register 741 so that no ENST IRQ is generated.

An INTV IRQ generated by the flip-flop 738, an ENST IRQ generated by the flip-flop 744, and IRQs generated by the ADC1 and ADC2 are set into flip-flops 740, 746, 764, and 768, respectively. A signal for generating/inhibiting IRQ is set into each of flip-flops 739, 745, 762, and 766. If "H" is set in any one of the flip-flops 739, 745, 762, and 766, corresponding one of AND gates 748, 750, 770, and 772 is enabled so that an IRQ is immediately generated through an OR gate 751. Thus, an IRQ can be inhibited from generation, or released from inhibition by setting "H" or "L" into the respective flip-flops 739, 745, 762 and 766. The cause of generation of IRQ is removed by taking the contents of the flip-flops 740, 746, 764 and 768 into the CPU 102.

When the CPU 102 begins to execute a program in response to an IRQ, it is necessary to delete the IRQ signal and, therefore, specific one of the flip-flops 740, 746, 764 and 768 concerned with the specific IRQ is cleared.

Referring to FIGS. 24 to 27, a first embodiment of the present invention will be described in detail, in which the number of engine revolutions is stably controlled in the process shifting from the state of starting by the engine starter motor to the state of self cranking.

In an idling operation of the engine, particularly in starting, the opening area of the by-pass is changed in the process shifting from the state of starting by the starter motor to the state of self cranking. That is, the actuation duty factor of the by-pass valve is changed at a boundary, that is, the number of revolutions required for self cranking (usually, about 400 r.p.m.). That is, the duty factor of the by-pass valve for open loop control, i.e. the duty factor of the by-pass valve under the condition that the feedback control performed on the basis of information with respect to the number of engine revolutions is not effected, in starting is changed from that after the completion of the starting operation. Before self cranking, a considerable quantity of suction air is required to cause the engine to start and, therefore, it is necessary to supply a large quantity of air to the engine through the by-pass because the throttle valve is in the closed state at this time. Accordingly, in starting, it is necessary enlarge the area of opening of the by-pass than in self cranking. The duty factor of the by-pass valve before self cranking is obtained from a map showing various duty factors of the by-pass valve for obtaining the necessary opening area of the by-pass which is determined in accordance with the temperature of engine cooling water. The duty factor in self cranking is obtained, on the other hand, from a map showing various duty factors for obtaining a somewhat narrower opening area of the by-pass which is determined in accordance with the temperature of the engine cooling water, because, in self cranking, a large quantity of the air is not required as that in starting, i.e. before self cranking.

That is, in the idle running control (hereinafter referred to as ISC), the ISC open duty factor $K_1$ determined on the basis of a value taken-in from the cooling water sensor 56 in starting is used as the ON duty factor of the by-pass valve in starting by using the starter motor, as shown by a line $l_1$ in FIG. 24. When the engine running has reached the state of self cranking in which the engine can rotate without enlisting the aid of the starter motor upon the completion of the starting running by using the starter motor, that is when the number of engine revolution has reached its self-cranking value $N_1$ (usually, about 400 r.p.m.), the by-pass valve ON duty factor $K_0$ corresponding to the temperature of cooling water in state of self cranking is selected on the basis of the ISC duty factor map along the line $l_2$ as shown in FIG. 24. Thus, the by-pass valve ON duty factor is changed over at the number of engine revolutions of self cranking $N_1$ as the boundary. Since the difference between the duty factors $K_1$ and $K_0$ is large, however, the number of engine revolutions falls down swiftly at the change-over of duty factor as shown by the curve $m_1$ in FIG. 25. If the change-over of duty factor is effected so early that the number of engine revolutions at that time has not yet reached the number of engine revolutions of self-cranking $N_1$, the number of engine revolutions falls down rapidly as shown by the curve $m_4$. Further, if the change-over of duty factor is effected so later that the number of engine revolutions at that time is higher than the number of engine revolutions of self-cranking $N_1$, the number of engine revolutions may over shoot with respect to the number of engine revolutions of idle running $N_{REF}$ as shown by the curve $m_5$. Accordingly, disclosed here is a method to smoothly shift the number of engine revolutions to the reference number of engine revolutions of idle running $N_{REF}$ by gradually reducing the by-pass valve ON duty factor from a predetermined value, which is selected as an initial duty factor after the duty-factor change-over between the value $K_1$ before self cranking and the value Ko in self cranking, until the duty factor has reached the value Ko. That is, the difference between the by-pass valve ON duty factor $K_1$ before self cranking and the by-pass valve ON duty factor Ko in self cranking is multiplied by a predetermined factor k (for example 0.5) to obtain a value $\Delta K$ to which the value Ko is added to obtain a value $K_2$ ($=Ko+\Delta K$) which is used as the above-mentioned initial value of the by-pass valve ON duty factor after the state of self cranking has reached. Thereafter, the by-pass valve ON duty factor in self cranking is decreased from the initial value $K_2$ step by step by a predetermined value $\Delta D$ at regular or predetermined intervals of time until it has reached the value Ko, as shown in FIG. 24. In this manner, the number of engine revolutions can gradually smoothly reach its value of desired idling running, as shown by a solid line curve $m_0$ in FIG. 25. It is noted that, even in the case where the duty factor is changed over at a time somewhat shifted, forward or backward, from the timing corresponding to the number of engine revolutions $N_1$ indicating self cranking, the number of engine revolutions can be stably shifted to the value of idling running along the curve $m_0$.

FIG. 26 shows the relation between the by-pass valve ON duty factor and the temperature of cooling water after the state of self cranking has been reached. In this drawing, the curves $K_1$ and $K_2$ show the ON duty factor characteristics before and in self cranking respectively.

FIG. 27 shows a flowchart for processing the by-pass valve ON duty factor in the ISC. This flowchart is executed at regular or predetermined intervals of time, for example every 160 msec. In the step 1001, first, judgement is made as to whether the present number of engine revolution N is larger than the self cranking number of engine revolution $N_1$ and if the result of judgement proves that the former is larger than the latter, that is the state of self cranking has been reached, the processing is shifted to the step 1002, while if it proves that the former is smaller than the latter, that is if the state of self cranking has not yet been reached, the flag of starting is set to "1" in the step 1003. Upon the setting "1" in this starting flag, the ON duty factor $K_1$ before self cranking is retrieved in the map on the basis of the temperature of cooling water in the step 1004, and the value $K_1$ is set in the ISCC 142 as the by-pass valve ON duty factor in the step 1005. Thus, the by-pass valve 62 is controlled by the output signal of the ISCC 142 such that its ON duty factor is made to take the value $K_1$. In the step 1002, judgement is made as to whether the starting flag is "1" or not, and if "1", the processing is shifted to the step 1006 in which the starting flag is reset to "0". Then, in the step 1007, the ON duty factor Ko after the state of self cranking has been reached is retrieved in the map on the basis of the cooling water temperature TW. In the step 1008, the value $\Delta K=(K_1-K_0)Xk$ is obtained and set in the RAM. That is, the difference between the values $K_1$ and Ko is multiplied by the predetermined factor k (for example, $k=0.5$) to obtain the value $\Delta K$. In the step 1009, next, the value Ko is added to this value $\Delta K$ and the sum is set in the ISCC 142 as the initial value of the by-pass valve ON duty factor in self cranking.

If the result of the judgement in the step 1002 proves that the starting flag is "0", on the contrary, the predetermined value $\Delta D$ is subtracted from the previous $\Delta K$, i.e. $\Delta K_{OLD}$, to obtain the present value $\Delta K_{NEW}$ which is stored in the RAM. In the step 1011, then, judgement is made as to whether the ON duty factor $\Delta K_{NEW}$ obtained in the step 1010 is equal to or smaller than zero, and when the result of judgement proves that the value $\Delta K_{NEW}$ is larger than zero, the processing is shifted to the step 1013, while, when it proves that the value $\Delta K_{NEW}$ is not larger than zero, it is determined that the processing to decrease the ON duty factor has been completed and the processing to make $\Delta K_{NEW}$ zero is effected in the step 1012. In the step 1013, then, the ON duty factor after the state of self cranking has been reached is retrieved on the map on the basis of the cooling water temperature TW. In the step 1014, next, the value Ko is added to the value $\Delta K_{NEW}$ and the sum is set into the ISCC. If the result of judgement proves that $\Delta K_{NEW} \geqq 0$ in the step 1011, the by-pass valve ON duty factor is thereafter subjected to the feedback control based on the number of engine revolution.

Further, if the factor k in the step 1008 is selected to a value $0.5<k<1$ and the initial value of the ON duty factor in self cranking is set to a value $K_3$ ($K_2<K_3<K_1$) as shown in FIG. 24 so that the ON duty factor is decreased from this initial value $K_3$ by the predetermined value $\Delta D$ step by step in self cranking as shown by the broken line $l_3$ in FIG. 24, the number of engine revolutions may somewhat overshoot after the change-over of duty factor as shown by the curve $m_3$ in FIG. 25. If the factor k is selected to a value $0<k<0.5$ and the initial value of the ON duty factor in self cranking is set to a value $K_4$ ($Ko<K_4K_2$) so that the ON duty factor is decreased from this initial value $K_4$ by the predetermined value $\Delta D$ step by step in self cranking as shown by the broken line $l_4$, alternatively, the number of engine revolutions may become somewhat smaller after the change-over of duty factor as shown by the curve $m_4$.

Thus, in this embodiment, the number of engine revolutions after the state of self cranking has been reached can be smoothly controlled by controlling the by-pass valve ON duty factor.

Figure 28:
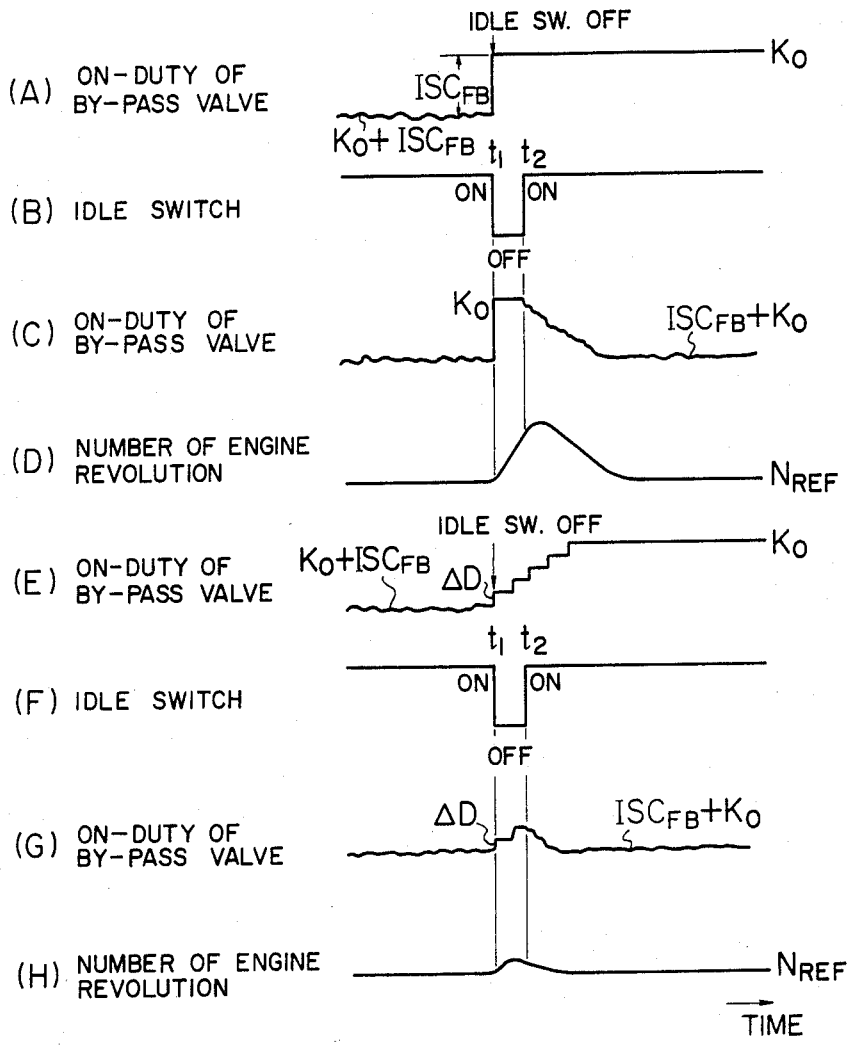

Referring to FIGS. 28 and 29, another embodiment in which the number of engine revolutions can be stably controlled when the idling switch is changed over from its ON state to its OFF state in the ISC will be described hereunder.

In the by-pass valve ON duty factor control in the ISC after the engine state of self cranking has been reached, the ON duty factor has a value of the sum of a fixed value or component Ko of ON duty factor which is determined in accordance with the cooling water temperature and an additional or feedback component $ISC_{FB}$ corresponding to the quantity of feedback of the number of engine revolutions for controlling the number of engine revolutions to the reference number of engine revolutions for idle running $N_{REF}$. The additional or feedback component $ISC_{FB}$ is a compensating value determined in accodance with the difference between the present number of engine revolutions N and the reference number of engine revolutions for idle running $N_{REF}$. In the OFF state of the idling switch, the ON duty factor has only the fixed component Ko determined in accordance with the cooling water temperature. Upon the change-over of the idling switch from its ON state to OFF in the ISC, the feedback component $ISC_{FB}$ of the ON duty factor which has existed in the ON state of the idling switch as shown in FIG. 28(A) becomes zero and the ON duty factor is clamped to the value of the fixed component Ko determined in accordance with the cooling water temperature. That is, open loop control begins. Although the feedback component $ISC_{FB}$ shown in FIG. 28(A) has a negative value, it may of course have a positive value. Accordingly, in the case where the ON duty factor in idle running is controlled to have a value lower than the fixed component Ko, that is, when the feedback component $ISC_{FB}$ has a negative value, the control is made to be the open loop one when the idling switch is turned OFF. Thus, the feedback component of the ON duty factor becomes zero and the ON duty factor is constituted by only the fixed component Ko, so that the value of the ON duty factor increases immediately. Accordingly, thereafter, if the idling switch is turned ON at the time $t_2$ as shown in FIG. 28(B), the feedback control is started again. Thus, the ON duty factor has again the fixed component Ko as well as the feedback component $ISC_{FB}$ (negative value in this embodiment) which is determined in accordance with the difference $\Delta N$ between the present value of the number of engine revolutions N and the reference number of engine revolutions for idle running $N_{REF}$ and the ON duty factor is gradually decreased to the value for idle running because the absolute value of the feedback component gradually increases. In the case where the feedback component $ISC_{FB}$ takes a positive value, the ON duty factor in the OFF state of the idling switch, which is the fixed component Ko, is lower than the ON duty factor on the ON state of the idling switch. Accordingly, upon the turning ON of the idling switch the ON duty factor gradually increases by the feedback control. Accordingly, the ON duty factor changes as follows when the ON-OFF operation of the idling switch is repeated rapidly as shown in FIG. 28(B), that is, when the depression and release of the accelerator is temporarily repeated. That is, the ON duty factor changes immediately to the value of the fixed component Ko determined in accordance with the cooling water temperature as shown in FIG. 28(C) upon the turning OFF of the idling switch and clamped to the value Ko during the OFF period of the idling switch. When the idling switch is turned ON again at the time $t_2$ on the assumption that the feedback component $ISC_{FB}$ is negative, the ON duty factor gradually decreases from the clamped value Ko to the value for idle running, that is $ISC_{FB}+Ko$. Thus, there is a disadvantage that the number of engine revolutions increases rapidly upon the turning OFF of the idling switch as shown in FIG. 28(D) because the ON duty factor is larger in the OFF state of the idling switch than the ON duty factor in idle running. Thus, the rapid repetition of ON-OFF state of the idling swtich causes rapid rising of the engine speed, resulting in unconfortable feeling for the driver.

To cope with this disadvantage, it is convenient to cause the ON duty factor to change step by step as shown in FIG. 28(E) upon the turning OFF of the idling switch, while suppressing the immediate change to the fixed value Ko determined in accordance with the cooling water temperature. Thus, upon the turning OFF of the idling switch at the time $t_1$ FIG. 28(F) the ON duty factor rises from the value in idle running toward the fixed value Ko gradually step by step as shown in FIG. 28(G), and when the idling switch is turned ON again at the time $t_2$ before the fixed value Ko has not been yet reached, the feedback control begins from that time so as to control the ON duty factor to become the ON duty factor for idle running. Thus, the number of engine revolutions can be prevented from temporarily and rapdily rising upon the turning OFF of the idling switch as shown in FIG. 28(H).

FIG. 29 shows a processing flow for the embodiment as described above. This flow is executed at regular or predetermined time intervals, for example, every 160 msec. First, judgement is made as to whether the idling switch is in the OFF state or not in the step 1101, and if the result of judgement proves that the idling switch is in the OFF state, judgement is made as to whether the feedback component $ISC_{FB}$ of the ON duty factor for idle runnign is not smaller than zero in the step 1102. When the result of judgement in the step 1102 proves that the feedback component $ISC_{FB}$ is smaller than zero, a predetermined ON duty factor value $\Delta D$ is added to the feedback component $ISC_{FB}$ so as to obtain a new value of feedback component and the previous value of the feedback component is replaced by the thus obtained new value, in the step 1104. In the step 1107, then, map-retrieval is effected to obtain the ON duty fixed component Ko determined in accordance with the cooling water temperature, the feedback component $ISC_{FB}$ obtained in the step 1104 is added to this fixed component Ko, the sum $Ko+ISC_{FB}$ is set into the RAM, and the by-pass valve 62 is controlled by the output pulse of the ISCC 142. If the result of judgement in the step 1102 proves that the feedback component $ISC_{FB}$ is equal to or larger than zero, further judgement is made in the step 1103 as to whether the feedback component $ISC_{FB}$ is zero or not. If the result of judgement in the step 1104 proves that the feedback component $ISC_{FB}$ is zero, the sum of the fixed component Ko determined in accordance with the cooling water temperature which has been obtained by the map-retrieval and the feedback component $ISC_{FB}$ (this value is now zero), that is, the fixed value Ko determined in accordance with the cooling water temperature is set into the ISCC as the by-pass valve ON duty factor. If the result of judgement in the step 1103 proves that the feedback component $ISC_{FB}$ is not zero, that is, larger than zero, on the contrary, a predetermined negative value of the ON duty factor changing value $(-\Delta D)$ is added to the previous value of the feedback component $ISC_{FB}$ so as to decrease the latter to thereby obtain a new value of the feedback component $ISC_{FB}$ in the step 1105. The new value of feedback component $ISC_{FB}$ obtained in the step 1105 is added to the fixed component Ko determined in accordance with the cooling water temperature and the sum is set in the ISCC in the step 1107. If the result of judgement in the step 1101 proves that the idling switch is on the ON state, on the contrary, the feedback component $ISC_{FB}$ is obtained in accordance with the difference between the actual value of the number of engine revolution N and the reference value of the number of engine revolution for idle running $N_{REF}$ in the step 1106 so as to perform the feedback control on the basis of the number of engine revolution. In the step 1107, then, the value $ISC_{FB}$ obtained in the step 1106 is added to the fixed component Ko determined in accordance with the cooling water temperature and the sum is set in the ISCC.

Thus, in this embodiment, a predetermined value $\Delta D$ is added to or substracted from the ON duty factor for idle running step by step at regular or predetermined intervals of time so as to reduce the value of the feedback component $ISC_{FB}$ to zero. Since the ON duty factor chages gradually toward the fixed value Ko, the number of engine revolutions is prevented from being changed suddenly, as shown in FIG. 28(H).

Next, a third embodiment will be explained referring to FIGS. 30 to 33, in which the by-pass valve ON duty factor is controlled so that the number of engine revolution can be smoothly changed when the idling switch is turned ON from the OFF state, that is when the engine state is changed from normal running to an idling operation.

If the idling switch is turned ON from its OFF state at the time $t_1$ as shown in FIG. 30(A), the feedback control with respect to the by-pass valve ON duty factor is started as shown in FIG. 30(B). That is, the ON duty factor for the OFF state of the idling switch, i.e. the value $(Ko+ISC_{FB})$ which is the sum of the ON duty factor fixed component Ko and the ON duty factor feedback component $ISC_{FB}$ corresponding to the difference $\Delta N$ between the actual value of the number of engine revolutions N and the reference value of the number of engine revolution for idle running $N_{REF}$, is outputted as the ON duty factor at this time. That is, if the feedback component $ISC_{FB}$ has a negative value (hereinafter, it is assumed that the value $ISC_{FB}$ is negative in this embodiment), the value $ISC_{FB}$ is decreased at regular or predetermined intervals of time by a feedback component changing value $\Delta D$ (negative value) which is determined by the above-mentioned difference value $\Delta N$ in the number of engine revolutions and, therefore, the by-pass valve ON duty factor gradually decreases after the time $t_1$, as shown in FIG. 30(B). In the case where the ON duty factor is determined to control the number of engine revolutions to the reference number of engine revolutions $N_{REF}$ by feedback control, however, the number of engine revolutions may be so reduced below the reference number of engine revolutions $N_{REF}$ (overshoot) as shown in FIG. 30(C) when it is reduced toward the reference number of engine revolutions by the feedback control, with the possibility of occurence of engine stoppage. If the number of engine revolutions N comes below the reference number of engine revolutions for idle running $N_{REF}$ (at the time $t_3$), the difference $\Delta N=N-N_{REF}$ becomes negative and therefore the changing value $\Delta D$ becomes positive so that the feedback component $ISC_{FB}$ increases gradually. To cope with this problem, a method has been proposed conventionally, in which the feedback control is started upon the turning ON of the idling switch at the time $t_1$ as shown in FIG. 30(D) so as to decrease the ON duty factor step by step by the ON duty factor changing value $\Delta D$ to thereby reduce the number of engine revolutions N toward the reference number of engine revolutions $N_{REF}$, and when the number of engine revolutions N has reached a given value which is the sum $(N_{REF}+\Delta No)$ of the reference number of engine revolutions $N_{REF}$ and a predetermined fixed value $\Delta No$ (for example, 400 r.p.m.) at the time $t_2$, the ON duty factor feedback control is stopped, that is the decreasing of the value $ISC_{FB}$ is stopped, so that the by-pass valve ON duty factor is caused to come back to the fixed component Ko and the feedback control is effected again to thereby converge the number of engine revolutions to the desired value, as shown by the broken curve in FIG. 30(C). In this method, however, the number of engine revolutions may overshoot to downward exceed the desired value $N_{REF}$ as shown by the broken curve in FIG. 30(C) even if the ON duty factor is increased at the time where the number of engine revolutions has reached the value which is the sum of the desired value $N_{REF}$ and the predetermined value ΔNo.

In the third embodiment according to the present invention, therefore, the feedback control is not immediately effected upon the turning ON of the idling switch at the time $t_1$ but started when the number of engine revolution has reduced to the value which is larger than the reference or desired value $N_{REF}$ by a predetermined value ΔNo (for example, 400 r.p.m.), as shown in FIGS. 30(E) and (F). Although it takes a longer time for the number of engine revolutions to reach the value of the sum of the desired number of engine revolutions $N_{REF}$ and the fixed value ΔNo in comparison with the case of FIG. 30(D) (actually, the period of time is so short that it is difficult to clearly find the difference by measurement), the number of engine revolutions can be quickly converged, after the initiation of the feedback control, to the desired reference value in comparison with the conventional case without overshooting.

In such a method in which the feedback control is started from the time where the number of engine revolutions has reached the value which is larger than the desired reference value $N_{REF}$ by the fixed value ΔNo, assume that after normal running, the accelerator is released at the third, fourth, or top gear position to effect engine braking to gently decrease the number of engine revolutions and the clutch is turned OFF before the number of engine revolutions has reached a sufficiently low value at which knocking may occur. Then, the number of engine revolutions may largely fall down at the time $t_2$ as shown in FIG. 31(A) because the engine load becomes light at that time. That is, if the idling switch is turned ON and the engine braking is effected at time $t_1$ where the number of engine revolutions has reached the value $N_1$ ($N_1 = N_{REF} + \Delta No$), the decrease of the number of engine revolutions becomes gentle so that rate of reduction of the value $\Delta N = (N - N_{REF})$ becomes smaller to maintain the changing value ΔD of the feedback component $ISC_{FB}$ large, whereby the ON duty factor ($Ko + ISC_{FB}$) decreases rapidly as shown in FIG. 31(B) to rapidly reduce the number of engine revolutions toward the desired value. In such a case where the changing value ΔD of the feedback component $ISC_{FB}$ has reached a large value, if the clutch is turned OFF at the time $t_2$ where the number of engine revolutions is $N_2$ so as to provide non-braking condition, the engine load decreases rapidly and the number of engine revolutions falls down rapidly to overshoot or downward exceed the reference value $N_{REF}$. If the number of engine revolutions becomes lower than the reference value $N_{REF}$, the reduction of the number of engine revolutions can not be sufficiently recovered although the changing value ΔD becomes positive to act to increase the value $ISC_{FB}$. To cope with this problem, the rate of change of the number of engine revolutions upon the initiation of the feedback control, i.e. immediately after the idling switch has been turned ON from its OFF state, is obtained so that when the rate of change is smaller than a predetermined value, the gain of feedback control, i.e. the feedback changing value ΔD, is made small to increase the rate of change of the ON duty factor ($Ko + ISC_{FB}$) to effect the feedback control gently as shown in FIG. 31(C). Thus, the number of engine revolutions can be converged to the desired value rapidly without overshooting, as shown in FIG. 31(D).

Further, the feedback control is started at the time where the number of engine revolutions is larger than the desired value $N_{REF}$ by ΔNo and therefore the rate of reduction of the number of engine revolutions may be large if there exists a load such as air conditioner at the time when the feedback control is started. Accordingly, if the feedback control is started at the time $t_1$ at which the number of engine revolutions has become a value $N_1$ which is larger than the desired value $N_{REF}$ by the value ΔNo so as to perform ordinary feedback control as shown by the curve $P_1$ in FIG. 32(B), the number of engine revolutions decreases suddenly so as to downward exceed the desired value $N_{REF}$ as shown by solid line in FIG. 32(A). To cope with this problem, when the rate of reduction of the number of engine revolutions is larger than a predetermined value at the time at which the number of engine revolutions becomes the abovementioned value $N_1$, the ON duty factor increment ISCD is obtained in accordance with the rate of reduction as shown in FIG. 32(B) and the increment ISCD is added to the ON duty factor ($Ko + ISC_{FB}$) so as to perform the feedback control by using this sum ($Ko + ISC_{FB} + ISCD$) as the ON duty factor which is decreased step by step at regular or predetermined intervals of time (for example, every 160 msec) by the ON duty factor changing value ΔD determined on the basis of the difference ΔN between the present number of engine revolutions N and the desired or reference number of engine revolutions $N_{REF}$. In this manner, the number of engine revolutions gradually decreases after the time $t_1$ and smoothly reaches the desired or reference value $N_{REF}$ without downwardly exceeding the desired value. The ON duty factor increment ISCD is maintained constant while the rate of reduction of the number of engine revolutions is substantially constant, and increased or decreased in accordance the value of the rate of reduction of the number of engine revolutions when the rate of reduction increases or decreases, respectively.

Figure 30:
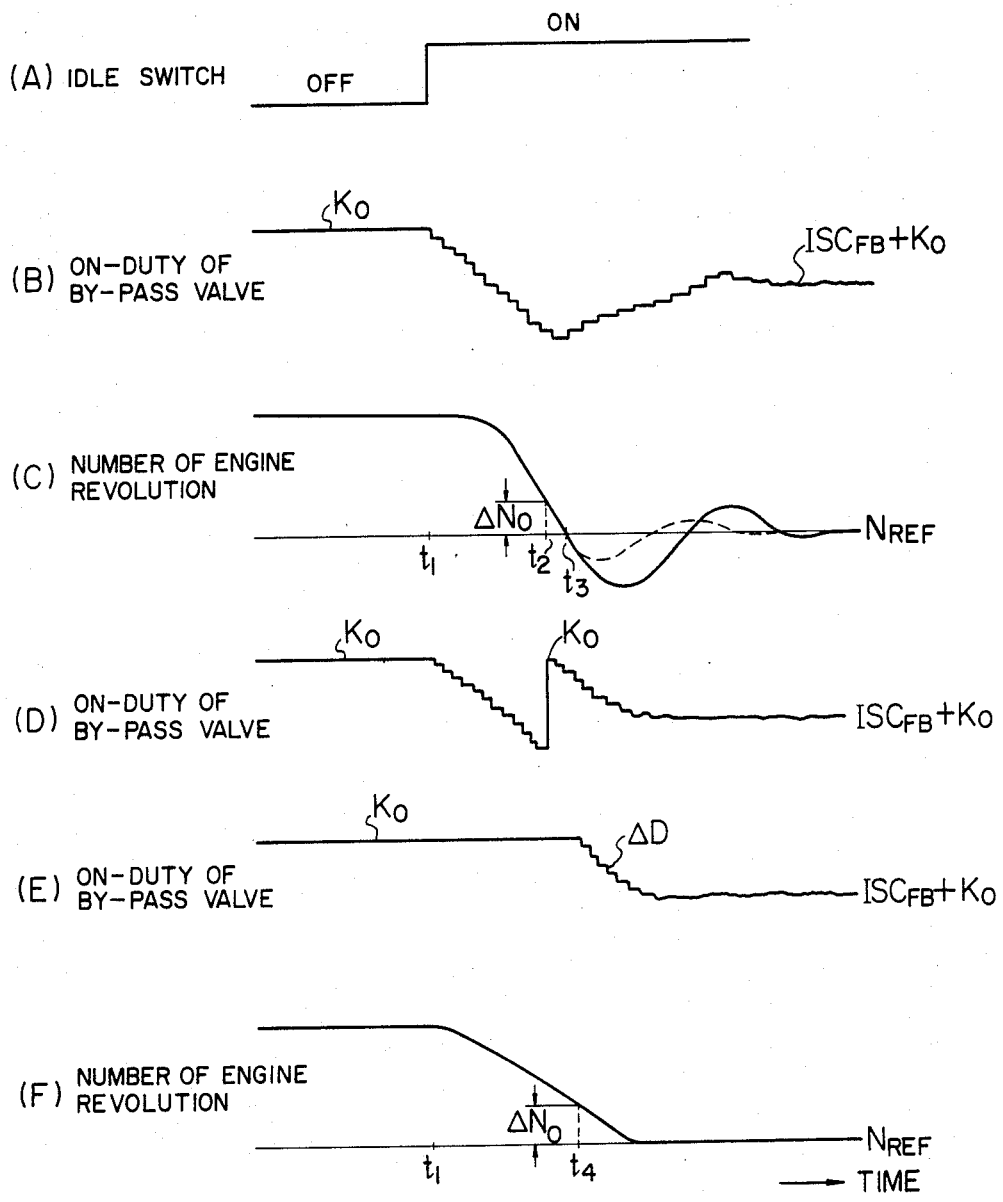
Figure 31:
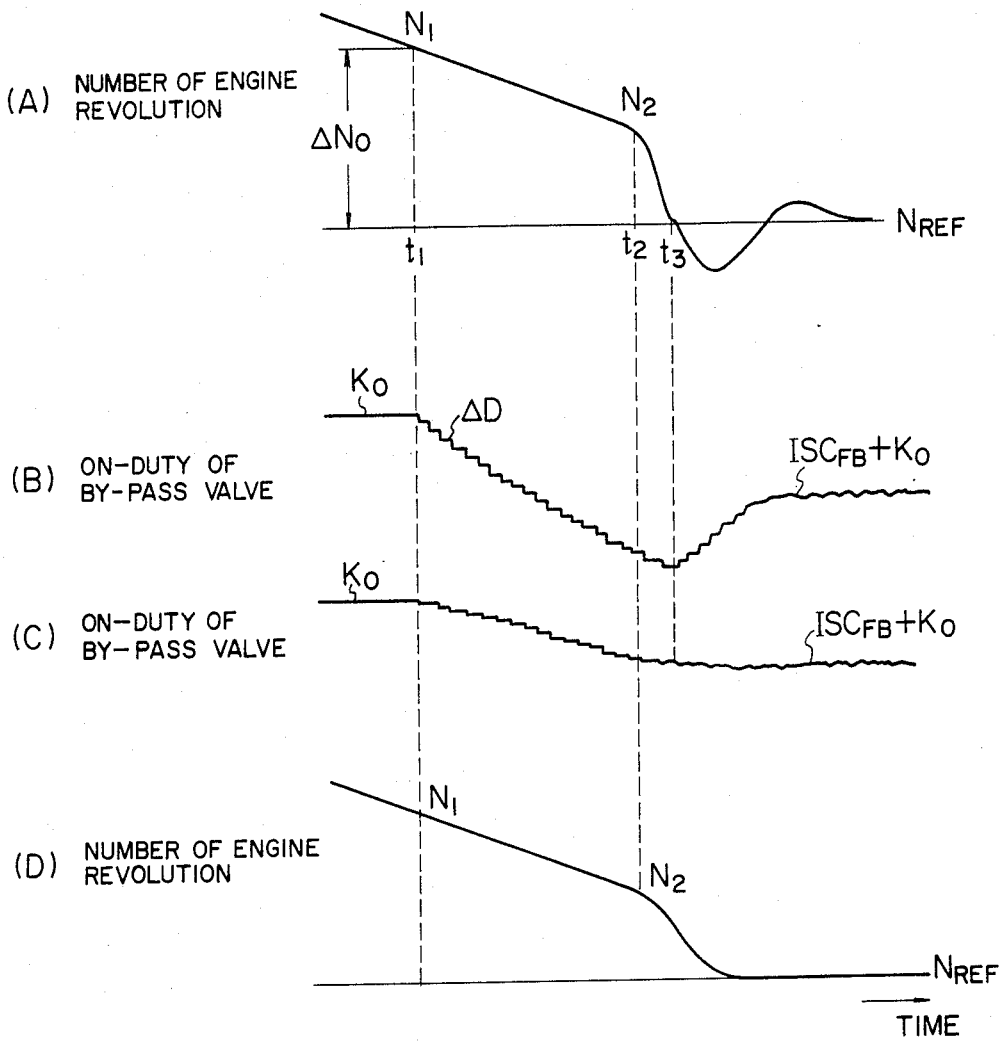
Figure 32:
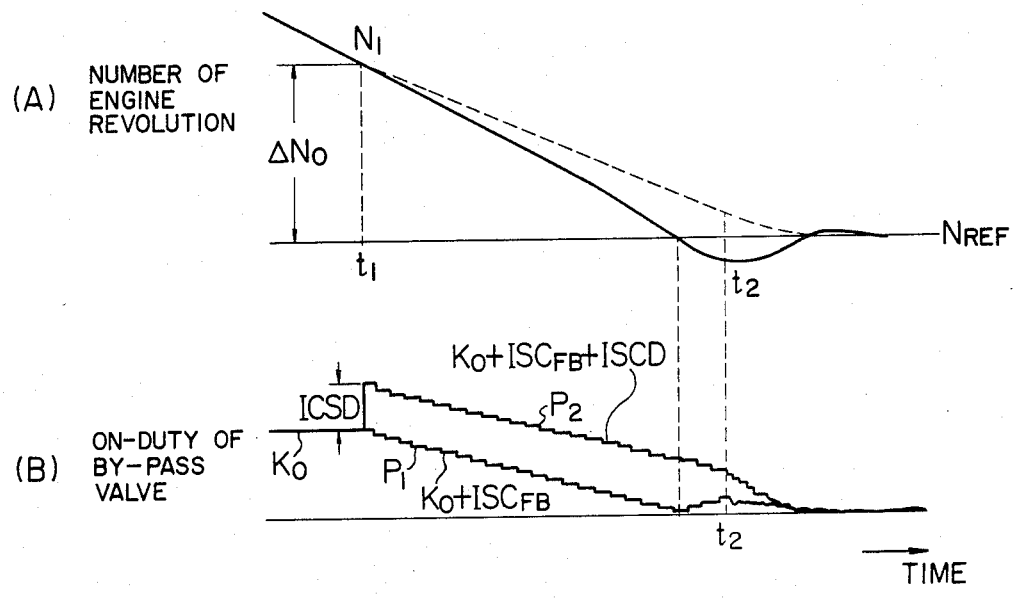

Referring to the flowchart shown in FIG. 33, the embodiment in which the by-pass valve ON duty factor after the turning-on of the idling switch is controlled as shown in FIGS. 30 to 32 will be described hereunder. It is assumed that the processing flow of FIG. 33 is executed every 160 msec and that the feedback component $ISC_{FB}$ has a negative value in this processing flow as shown in FIGS. 30 to 32.

In the step 1201, first, the number of engine revolutions is read and be stored as $N_{NEW}$ in a predetermined area of the RAM and the previously read value is shifted as $N_{OLD}$ to another area in the RAM. Next, judgement is made as to whether the ON duty factor increment ISCD is zero or not in the step 1202. If the result of judgement proves that the increment ISCD is not zero, a predetermined ON duty factor value Δd is subtracted from the ON duty factor increment ISCD and the resulted value is stored in a predetermined area of the RAM in the step 1203, and the processing is shifted to the step 1204 when the result of judgement proves that the increment ISCD is zero in the step 1202. On the contrary, the processing is shifted to the step 1204. In the step 1204, judgement is made as to whether the idling switch is in the ON state or not. If the result of judgement in this step proves that the idling switch is in the OFF state, a flag 1 is set to "1" in the step 1205 and a flag 2 is reset to "0" in the step 1206. The flag 1 is for indicating the OFF state of the idling switch and the flag 2 is for executing the control to minimize the changing value ΔD for the ON duty factor feedback component $ISC_{FB}$. When the result of judgement proves that the idling switch is in the OFF state, it is considered that system is to be subjected to open loop control and the ON duty factor fixed component Ko is map-retrieved on the basis of the cooling water temperature in the step 1207 so as to be set into the register ISCC 142.

If the result of the judgement in the step 1204 proves that the idling switch is ON, the reference number of engine revolutions for idle running $N_{REF}$ is computed on the basis of the cooling water temperature and stored in a predetermined area of the RAM in the step 1208. In the step 1209, next judgement is made as to whether "1" is set in the flag 1 or not. If the result of judgement proves that "1" is not set to the flag 1, it is considered that the idling switch has been left in the ON state and the processing is shifted to the step 1214. If the result of judgement in the step 1209 proves that "1" is set in the flag 1, it is considered that the state of the idling switch has been changed from its OFF state to ON and judgement is made in the step 1210 as to whether the number of engine revolutions $N_{NEW}$ taken-in in the step 1201 is not smaller than the value obtained by adding the value ΔNo to the reference number of engine revolutions $N_{REF}$ for idle running. If the result of judgement in this step 1210 proves that the value $N_{NEW}$ is equal to or larger than the sum of the value $N_{REF}$ and the value ΔNo, it is considered that the ON duty factor is not yet to be subjected to the number-of-engine-revolution feedback control but to the open loop control and the processing is shifted to the step 1224. In the step 1224, the ON duty factor fixed component Ko is map-retrieved on the basis of the cooling water temperature and set into the register ISCC 142. Thus, open loop control is effected after the turning ON of the idling switch and before the time $t_1$. If the result of judgement in the step 1210 proves that the value $N_{NEW}$ is smaller than the sum of the value $N_{REF}$ and the value ΔNo, on the contrary, it is considered that the number-of-engine-revolutions feedback control for the ON duty factor is to be effected and the flag 1 is reset in the step 1211. In the step 1212, then, the rate of change of the number of engine revolutions ($\Delta n = N_{OLD} - N_{NEW}$) is obtained from the respective values of the number of engine revolutions $N_{NEW}$ and $N_{OLD}$ taken-in in the step 1201 and judgement is made as to whether this Δn is smaller than a predetermined value $\Delta n_o$ or not. If the result of judgement in the step 1212 proves that the rate of reduction of the number of engine revolutions ($\Delta n = N_{OLD} - N_{NEW}$) is equal to or larger than the predetermined value $\Delta n_o$, the processing is shifted to the step 1214. If the value Δn is smaller than the predetermined value $\Delta n_o$, "1" is set in the flag 1 in the step 1213. That is, the changing value ΔD for the feedback component $ISC_{FB}$ is set to a minimum value when the rate of reduction of the number of engine revolutions Δn is smaller than the predetermined value $\Delta n_o$ at the time $t_1$ as shown in FIG. 31, and "1" is set to the flag 1 to indicate such control.

Upon the resetting of the flag 1 in the step 1211, the processing is shifted from the step 1209 to the step 1214 after the time $t_1$. In the step 1214, next, the ON duty factor increment $ISCD_o$ is computed from the rate of reduction of the number of engine revolutions $\Delta n = N_{OLD} - N_{NEW}$ and stored into the RAM.

The increment $ISCD_o$ is set such that it is larger as the rate of reduction Δn is larger and set to zero when it is smaller than the predetermined value $\Delta n_1$, i.e. ($\Delta n_1 < \Delta n_o$). That is, as shown in FIG. 32, when the rate of reduction of the number of engine revolutions Δn is equal to or larger than the predetermined value $\Delta n_1$ after the time $t_1$, the increment ISCD in accordance with the rate of reduction Δn is add to the ON duty factor to prevent the sudden reduction in the engine speed.

Next, judgement is made as to whether the increment ISCD obtained in the step 1214 is larger than the increment $ISCD_o$ obtained in the step 1203. If the result of judgement proves that the increment $ISCD_o$ is not larger than the increment ISCD, that is when the rate of reduction of the number of engine revolutions Δn is smaller than the previous value of the same, the processing is shifted to the step 1217, and the increment ISCD which has been decreased by Δd obtained in the step 1203 is used in the ON duty factor computing in the later step 1223. In this manner, as shown in FIG. 32(B) after the time $t_2$, the increment ISCD is decreased by Δd step by step at regular or predetermined intervals of time as the rate of reduction of engine speed becomes smaller so that the reference number of engine revolutions $N_{REF}$ can be reached smoothly.

If the result of judgement proves that the increment $ISCD_o$ is larger than the increment ISCD, that is when the rate of reduction of the number of engine revolutions Δn is substantially equal to or larger than the previous value of the same, on the contrary, the increment $ISCD_o$ obtained in the step 1214 is made to be the increment ISCD which is used in the ON duty factor computing operation in the step 1223. This is, because, for example, in FIG. 32, when the rate of reduction of the number of engine revolutions becomes larger after the ON duty factor feedback control has been started and the ON duty factor has been increased by the increment ISCD after the time $t_1$, the increment ISCD is renewed to a larger value determined corresponding to the rate of reduction of the number of engine revolutions Δn to thereby prevent the engine speed from suddenly dropping.

In the step 1217, next, the reference number of engine revolutions $N_{REF}$ obtained in the step 1208 is compared with the number of engine revolution $N_{NEW}$ taken-in in the step 1201 to judge whether the former is not smaller than the latter. If the result of judgement in this step 1201 proves that $N_{REF}$ is smaller than $N_{NEW}$, the flag 2 is reset in the step 1218. That is, it is considered that the control to minimize the changing value ΔD for the ON duty factor feedback components $ISC_{FB}$ has been completed.

In the step 1219, then, judgement is made as to whether "1" is set in the flag 2 or not, so that when the flag 2 is set to "1", the changing value ΔD for the feedback component $ISC_{FB}$ is set to a minimum value in the step 1220, while if the result of judgement in the step 1219 proves that the flag 2 is not set to "1", the changing value ΔD for the feedback component $ISC_{FB}$ is obtained in accordance with the value $\Delta N = N_{REF} - N_{NEW}$ in the step 1221. The changing value ΔD is set such that it is larger as the value $\Delta N = N_{REF} - N_{NEW}$ becomes larger.

In the step 1222, next, the new feedback component $ISC_{FB(NEW)}$ is obtained from the previous feedback component $ISC_{FB(OLD)}$ (this value is assumed to be negative, here) and the changing value ΔD obtained in the step 1221. That is, the value $(ISC_{FB(OLD)}-\Delta D)$ is made $ISC_{FB(NEW)}$.

In the step 1223, then, ON duty factor is obtained from the value of increment ISCD determined in the steps 1215 and 1216 and the feedback component $ISC_{FB(NEW)}$ obtained from the step 1222. That is, the value $Ko+ISC_{FB(NEW)}+ISCD$ is computed and set in the ISCC 142.

Thus, as shown in FIG. 31, if the number of engine revolutions decreases gradually when the engine brake is actuated at the third, the fourth, or the top gear position under the condition that the number of engine revolutions feedback control has been started at the time $t_1$, the flag 2 is set to "1" in the steps 1212 and 1213 and the change value ΔD for the feedback component $ISC_{FB}$ is minimized, as shown in the steps 1217 to 1220, to thereby prevent the number of engine revolutions from suddenly dropping. It is noted that the ON duty factor increment ISCD is zero in this case.

As shown in FIG. 32, if the engine load is large and the rate of reduction of the number of engine revolutions is larger than the predetermined value $\Delta n_1$ under the condition that the number of engine revolutions feedback control has been started at the time $t_1$, the ON duty increment ISCD is obtained in the step 1214 on the basis of Δn, the larger one between this value ISCD and the value of difference obtained by subtracting the predetermined value Δd from the previous increment obtained in the step 1203 is obtained in the step 1215 and 1216, and the thus obtained value is added to the fixed and feedback components of the ON duty factor in the step 1223. In this manner, the ON duty factor is made larger to prevent the number of engine revolutions from dropping when the rate of reduction of the number of engine revolutions is large.

Although the description as to the embodiment shown in FIGS. 30 to 32 is made on the assumption that the feedback component $ISC_{FB}$ of the ON duty factor is negative, the present invention can be applied to the case where the feedback component $ISC_{FB}$ takes a positive value. In this case the feedback control is effected from the beginning because the number of engine revolutions N is always smaller than the sum $N_{REF}+\Delta No$. Further, the changing value Δd in the step 1203 and the changing value ΔD in the step 1221 are assumed to be negative, and the changing value ISCD for the ON duty is also assumed to be negative.

Referring to FIGS. 34 and 35, a fourth embodiment in which the number of engine revolutions is smoothly turned back to the value of the reference number of engine revolutions for idle running even if it deviates due to the change of load under the condition that the feedback control is being effected in the ISC, that is in the ON state of the idling switch.

As shown in FIGS. 34(A) and (B), if the load changes at the time $t_1$ under the condition that the number of engine revolutions is maintained at the reference value $N_{REF}$ for idling running in the ON state of the idling switch, e.g. if an air-conditioner is turned ON or a head light is lit so that the load increases, the number of engine revolutions will decrease from the reference value $N_{REF}$ for idling running. Accordingly, the feedback component $ISC_{FB}$ for the by-pass valve ON duty factor is increased by the increment ΔD determined in accordance with the difference $\Delta N=N-N_{REF}$ (where N being the present number of engine revolutions) step by step at regular or predetermined intervals of time so as to gradually increase the number of engine revolutions. If the present invention of engine revolutions exceeds the reference value $N_{REF}$ at the time $t_2$, the increment ΔD is set to a negative value so that the ON duty factor decreases gradually. The number of engine revolutions, however, continues to increase as it was for a time and then decreases because of response delay, until it reaches the reference value $N_{REF}$ for idle running. Since the number of engine reference delays in response to the change in ON duty factor, vibration or hunting may occur around the reference number of engine revolutions $N_{REF}$. In order to prevent this phenomena of vibration from occurring, after the ON duty factor increment which is performed at regular or predetermined intervals of time (for example every 160 msec) has been effected predetermined times (for example, fourteen times), the ON duty factor is clamped at its final value for a predetermined period of time (for example, 0.5 msec) so as to stop the feedback control during that period of time. Thereafter, the feedback is restarted upon the elapse of the predetermined period of time. Thus, the ON duty factor is gradually increased to increase the number of engine revolutions step by step to thereby prevent the hunting phenomena from occurring in the engine speed. Further, when the difference ΔN between the present number of engine revolutions N and the reference number of engine revolutions for idle running decreases beyond a predetermined value $\Delta N_1$, the ON duty factor clamping operation is stopped and the ON duty factor is increased step by step by the increment ΔD which is determined in accordance with the value ΔN.

FIG. 35 is a flowchart for performing the ON duty factor processing as described above. It is assumed that the flow is executed at regular or predetermined intervals of time, for example, every 160 msec, and shows the processing when the load becomes larger.

In the step 1301, judgement is made as to whether the idling switch is in the ON state or not. If the result of judgement in the step 1301 proves that the idling switch is in the OFF state, it is considered that the open loop control be effective, a flag indicating the stoppage of feedback control is reset, a counter for counting the times C of the feedback component increment operation is reset, and a timer for measuring the period of time during which the feedback control is stopped, in the step 1302. To perform the open loop control for the ON duty factor, the fixed component Ko of the ON duty factor is map-retrieved on the basis of the cooling water temperature and set in the register ISCC 142. If the result of judgement in the step 1301 proves that the idling switch is in the ON state, on the contrary, it is considered that the feedback control be effective, the reference number of engine revolutions $N_{REF}$ for idle running is obtained in accordance with the cooling water temperature and stored in the RAM in the step 1303. In the step 1304, then, judgement is made as to whether the feedback control stoppage flag is set to "1" or not. If the flag is set to "1", the value of the ON duty factor is clamped for the periods of time $t_2$-$t_3$ and $t_4$-$t_5$ as shown in FIG. 34(D). That is, if the result of judgement in the step 1304 proves that the flag is set to "1", 1 (one) is added to the contents T of a timer for counting the feedback control stoppage period of time (a software timer in the RAM) and the sum is considered as the new timer contents T in the step 1305.

In the step 1306, next, judgement is made as to whether the timer contents T obtained in the step 1305 has reached a predetermined value To or not, that is as to whether the clamping period of time has been terminated or not. If the timer contents T is smaller than the perdetermined value To, it is considered that the clamping period continues and the processing is shifted to the step 1315. In this case the predetermined period of time To is selected, for example, to 0.5 sec.

Thus, in the step 1315, judgement is made as to whether the difference ΔN between the reference number of engine revolutions $N_{REF}$ for idle running and the present number of engine revolutions N is smaller than a predetermined value $\Delta N_2$ or not, that is as to whether the difference ΔN has reached the value $\Delta N_2$ at which the clamping operation be terminated. In this case the difference ΔN is equal to or larger than the value $\Delta N_2$ and therefore the processing is shifted to the step 1317 in which the ON duty factor $Ko+ISC_{FB}$ is held as it is because the feedback and fixed components $ISC_{FB}$ and Ko of the ON duty factor are not renewed. If the timer contents T is equal to or larger than the predetermined value To in the step 1306, it is considered that the clamping period has been terminated and the processing is shifted to the step 1307. In the step 1307, the feedback control stoppage flag is reset, the counter is reset, the time for measuring the period of feedback control stoppage, that is the clamping period, is reset. Then, the processing is shifted to the steps 1315 and 1317 and the previous value of ON duty factor $Ko+ISC_{FB}$ is set in the register ISCC 142.

If the result of judgement proves that the flag is "0", it is considered that the timing to stop the feedback, that is, to perform the clamping, has not yet been reached, and therefore the flow for performing the increment of the ON duty factor feedback component. That is, the difference ΔN between the reference number of engine revolutions $N_{REF}$ for idle running and the present number of engine revolutions N ($\Delta N=N_{REF}-N$) is computed in the step 1308, and judgement is made as to whether the difference value ΔN is smaller than the predetermined value $\Delta N_1$, that is as to whether the difference value ΔN has reached the value $\Delta N_1$ at which the counting operation for counting the times of adding operation of the increment ΔD to the feedback component $ISC_{FB}$ has to be terminated. It is noted that the difference value $\Delta N_1$ is such that $\Delta N_1<\Delta N_2$ as shown in FIG. 34(C). Since it is not necessary to count the times of addition of the increment ΔD in the case where $\Delta N<\Delta N_1$, that since it is not required to perform the clamping operation thereafter, the processing is shifted to the step 1313. This corresponds to the case after the time $t_7$ in FIG. 34(C). In this case, the values $\Delta N_1$ and $\Delta N_2$ are set such that each of them appears between the number of engine revolutions $N_a$ at the time $t_7$ and the number of engine revolutions $N_b$ at the time when the increment ΔD has been successively added to the ON duty factor feedback component $ISC_{FB}$ predetermined times, for example, Co times, after the time $t_7$. The increment ΔD is obtained in the step 1313 from the difference ΔN obtained in the step 1308, and the thus obtained increment ΔD is added to the previous feedback component $ISC_{FB(OLD)}$ to obtain new feedback component $ISC_{FB(NEW)}$ in the step 1314. Further, the ON duty factor fixed component Ko is map-retrieved on the basis of the cooling water temperature. In the step 1315, then, judgement is made as to whether the value ΔN obtained in the step 1308 is not smaller than the predetermined value $\Delta N_2$ or not, that is as to whether the clamping operation be ended or not. If $\Delta N\geqq\Delta N_2$, the processing is shifted to the step 1317, while if $\Delta N<\Delta N_2$, it is considered that the clamping operation be terminated and the flag is reset. In the step 1317, then, the feedback and fixed components $ISC_{FB(NEW)}$ and Ko obtained in the step 1314 are added to each other and the sum is set in the register ISCC.

If the result of judgement in the step 1309 proves that $\Delta N\geqq\Delta N_1$, the times of addition of the increment ΔD is counted. That is, the contents C of the counter, that is the soeftware counter in the RAM, is incremented by 1 (one) to be its new contents C in the step 1310, and the processing is then shifted to the step 1311. In this step 1311, judgement is made as to whether the contents C of the counter is smaller than the predetermined value Co (for example, 14) or not. If the contents C is smaller than the predetermined value Co, it is considered that it is not necessary to clamp the ON duty factor and the processing is shifted to the steps 1313 and 1314 so that the fixed and feedback components of the ON duty factor are obtained and the ON duty factor $Ko+ISC_{FB(NEW)}$ is set in the register ISCC in the step 1317 through the step 1315.

The result of judgement in the step 1311 proves with respect to the counter contents C that $C\geqq Co$, it is considered that the clamping operation (that is the feedback control operation) be stopped and "1" is set in the feedback control stoppage flag in the step 1312, the processing being shifted then to the step 1315. This describes the state at the time $t_2$, $t_4$, etc. in FIG. 34(D). In the step 1315, next, judgement is made with respect to the value ΔN as to whether $\Delta N\geqq\Delta N_2$ or not, and if $\Delta N\geqq\Delta N_2$ the processing is shifted to the step 1317, while if $\Delta N<\Delta N_2$ the flag is reset in the step 1316. In the step 1317, the previous value of ON duty factor $Ko+ISC_{FB}$ is set in the register ISCC.

Although the case where load increases is explained in the embodiments described above, the present invention can be applied in the case where load decreases so that the number of engine revolutions increases to upward exceed the reference number of engine revolutions $N_{REF}$. In such a case, the difference value ΔN used in the steps 1308, 1309, 1313 and 1315 is obtained by the equation $\Delta N=N-N_{REF}$ and the increment ΔD takes a negative value. Thus, upon the reduction of load, the ON duty factor feedback component is decreased step by step so that the number of engine revolutions can be smoothly shifted to the reference number of engine revolutions.

What is claimed is:

1. In an engine control system comprising an intake path communicated with each cylinder of the engine through an intake manifold; a throttle valve provided in said intake path; a bypass provided in parallel with said throttle valve for enabling a flow of intake air into a lower portion of said throttle valve to bypass said throttle valve; a bypass valve for controlling an opening area of said bypass; a plurality of sensors including an angle sensor means for producing a pulse signal in synchronism with the revolutions of the crankshaft of the engine, an opening sensor means for producing a first output representing a first state of said throttle valve with said throttle valve in a substantially completely closed state and a second output representing a second state of said throttle valve when said throttle valve is not in the substantially closed state, and a water temperature sensor for detecting the temperature of cooling water of the engine; a central processing means for computing a value of duty factor for said bypass valve in response to the respective outputs of said plurality of sensors; and a pulse generating circuit means responsive to the output of said central processing means for supplying said bypass valve with a pulse signal representing the computed value of duty factor, said central processing means computes the number of engine revolutions on the basis of the output pulse signal of said angle sensor and the duty factor for said bypass valve is computed in accordance with the computed value of the number of engine revolutions and of the output of said angle sensor means; an engine control method comprising the steps of:

computing the duty factor for said bypass valve on the basis of the outputs of said plurality of sensors in an idle running operation of the engine;

supplying said bypass valve with a pulse signal representing a predetermined duty factor on the basis of said computed value of the duty factor;

obtaining a first duty factor for said bypass valve in a first engine state before a state has been reached in which the engine is driven by itself without requiring an external force;

obtaining a second duty factor for said bypass valve in a second engine state in an idling operation after the state has been reached in which the engine is driven by itself;

judging the engine state such that it is in said first engine state when said computed value of the number of engine revolutions is smaller than a predetermined value and that it is in said second engine state once said computed value of the number of engine revolutions is equal to or greater than said predetermined value;

supplying said bypass valve with a pulse signal representing first duty factor when the result of the judgment proves that the engine is in said first engine state;

supplying said bypass valve with a pulse signal representing an initial duty factor which is a predetermined value between said first and second duty factors when judgment is made that the engine state is changed from said first engine state to said second engine state;

supplying said bypass valve successively with a pulse signal representing a duty factor obtained by a step by step decreasing of said initial duty factor by a fixed value at predetermined time intervals; and wherein said first and second duty factors are determined on the basis of the detected value of cooling water temperature of the engine.

2. In an engine control system comprising an intake path communicated with each cylinder of the engine through an intake manifold; a throttle valve provided in said intake path; a bypass provided in parallel with said throttle valve for enabling a flow of intake air into a lower portion of said throttle valve to bypass said throttle valve; a bypass valve for controlling an opening area of said bypass; a plurality of sensors for detecting operating conditions of an engine including an angle sensor means for producing a pulse signal in synchronism with the revolutions of a crankshaft of said engine, an opening sensor means for producing a first output representing a first state of said throttle valve with said throttle valve in a substantially completely closed state and a second output representing a second state of said throttle valve when said throttle valve is not in the substantially closed state, and a water temperature sensor means for detecting the temperature of cooling water of the engine; central processing means for computing a value of a duty factor for said bypass valve in response to the respective outputs of said plurality of sensors, said central processing means computes the number of engine revolutions on the basis of the output pulse signal of said angle sensor means and the duty factor for said bypass valve is computed in accordance with the computed value of the number of engine revolutions and the output of said angle sensor means; and a pulse generating circuit means responsive to the output of said central processing means for supplying said bypass valve with a pulse signal representing the computed value of the duty factor; an engine control method comprising the steps of:

computing the duty factor for said bypass valve on the basis of the outputs of said plurality of sensors in an idling operation of the engine;

supplying said bypass valve representing a predetermined duty factor on the basis of said computed value of the duty factor;

obtaining a first duty factor for said bypass valve on the basis of the computed value of the number of enging revolutions when the first output is being produced by said opening sensor means;

obtaining a second duty factor for said bypass valve when said second output is being produced from said opening sensor means;

supplying said bypass valve with a pulse signal representing said first duty factor while said first output is being produced from said opening sensor means;

adding a fixed value to said first duty factor when the output of said opening sensor means is changed from said first value to said second value and supplying said bypass valve with a pulse signal representing the sum, the addition of said fixed value to the previous sum being repeated at predetermined time intervals so that a pulse signal representing the thus obtained sum is successively supplied to said bypass valve until the sum has reached said second duty factor; and said first and second duty factors are determined on the basis of the detected value of the cooling water temperature of the engine, said first duty factor is a sum of a temperature component determined by the temperature of cooling water of the engine and a feedback component determined by a difference between the computed value of the number of engine revolutions and a desired value of the number of engine revolutions in an idling operation determined on the basis of the cooling water temperature and the second duty factor is said fixed component.

3. An engine control method according to claim 2, in which said fixed value is negative when said feedback component is positive, while the former is positive when the latter is negative.

4. In an engine control system comprising an intake path communicated with each cylinder of the engine through an intake manifold; a throttle valve provided in said intake path; a bypass provided in parallel with said throttle valve for enabling a flow of intake air into a lower portion of said throttle valve to bypass said throttle valve; a bypass valve for controlling an opening area of said bypass; a plurality of sensors for detecting operating conditions of an engine including an angle sensor means for producing a pulse signal in synchronism with the revolution of a crankshaft of said engine, an opening sensor means for producing a first output representing a first state of said throttle valve with said throttle valve in a substantially completely closed state and a second output representing a second state of said throttle valve when said throttle valve is not in the substantially closed state, and a water temperature sensor means for detecting the temperature of cooling water of the engine; a central processing means for computing a value of a duty factor for said bypass valve in response to respective outputs of said plurality of sensors; and a pulse generating circuit means responsive to the output of said central processing means for supplying said bypass valve with a pulse signal representing the computed value of the duty factor, said central processing means computes the number of engine revolutions on the basis of the output pulse signal of said angle sensor means and the duty factor for said bypass valve is computed in accordance with the computed value of the number of engine revolutions and the output of said angle sensor means; an engine control method comprising the steps of:

computing the duty factor for said bypass valve on the basis of the outputs of said sensors in an idling operation of the engine;

supplying said bypass valve with a pulse signal representing a predetermined duty factor on the basis of said computed value of the duty factor;

obtaining a first duty factor for said bypass valve on the basis of the computed value of the number of engine revolutions when said first output is being produced from said opening sensor means;

obtaining a second duty factor for said bypass valve when said second output is being produced from said opening sensor means;

supplying said bypass valve with a pulse signal representing said first duty factor when the computed value of the number of engine revolutions becomes lower than said predetermined number of engine revolutions which is higher than the desired number of engine revolutions in an idling operation of the engine after the output of said opening sensor means has been changed from said second output to said first output; and wherein said first and second duty factors are determined on the basis of the detected value of the cooling water temperature of the engine, said first duty factor is a sum of a temperature component determined by the temperature of the cooling water of the engine and a feedback component determined by a difference between the computed value of the number of engine revolutions and a desired value of the number of engine revolutions in an idling operation of the engine determined by the cooling water temperature, and the second duty factor is said temperature component.

5. An engine control method according to claim 4, wherein said feedback component of said first duty factor is minimized when the rate of reduction in the computed value of the number of engine revolutions is less than a first predetermined rate of reduction.

6. An engine control method according to claim 4, wherein, when the rate of reduction in the computed value of the number of engine revolutions is larger than a second predetermined rate of reduction, an increment value of the duty factor determined by said rate of reduction at the time is added to said first duty factor.

7. An engine control method according to claim 6, wherein, when the rate of reduction in the number of engine revolutions increases, said increment value of the duty factor is renewed to a value corresponding to said increased rate of reduction in the number of engine revolutions.

8. An engine control method according to claim 7, wherein when the rate of reduction in the number of engine revolutions decreased, said increment value of duty factor is reduced by a fixed value.

9. In an engine control system comprising an intake path communicated with each cylinder of the engine through an intake manifold; a throttle valve provided in said intake path; a bypass provided in parallel with said throttle valve for enabling a flow of intake air into a lower portion of said throttle valve to bypass said throttle valve; a bypass valve for controlling an opening area of said bypass; a plurality of sensors for detecting operating conditions of an engine including an angle sensor means for producing a pulse signal in synchronism with the revolutions of a crankshaft of said engine, and an opening sensor means for producing a first output representing a first state of said throttle valve wherein said throttle valve is in a substantially completely closed state and a second output representing a second state of said throttle valve when the throttle valve is not in the substantially closed state;

a central processing means for computing a value of a duty factor for said bypass valve in response to the respective outputs of said plurality of sensors, said central processing means computes the number of engine revolutions on the basis of the output pulse signal of said angle sensor and the duty factor for said bypass valve is computed in accordance with the computed value of the number of engine revolutions and the output of said angle sensor means; and a pulse generating circuit means responsive to the output of said central processing means for supplying said bypass valve with a pulse signal representing the computed value of the duty factor; an engine control method comprising the steps of:

computing the duty factor for said bypass valve on the basis of the outputs of said plurality of sensors in an idle operation of the engine;

supplying said bypass valve with a pulse signal representing a predetermined duty factor on the basis of said computed value of the duty factor;

obtaining a duty factor for said bypass valve on the basis of the computed value of the number of engine revolutions when said first output is being produced from said opening sensor means;

clamping the value of said duty factor for a first predetermined period of time every time a second predetermined period of time has elasped, when the computed value of the number of engine revolutions deviates from a desired value of the number of engine revolutions in the idling operation of the engine under the condition that said first output is being produced from said opening sensor means.

10. An engine control method according to claim 9, wherein said plurality of sensors includes a water temperature sensor means for detecting the temperature of cooling water of the engine, and in which said duty factor is determined on the basis of the detected value of cooling water temperature of the engine.

11. An engine control method according to claim 10 wherein said duty factor is a sum of a temperature component determined by the temperature of the cooling water of the engine and a feedback component determined by a difference between the computed value of the number of engine revolutions and a desired value of the number of engine revolutions in the idling operation of the engine determined on the basis of the cooling water temperature.

12. An engine control method according to claim 11, in which the clamp of said duty factor is not effected when the difference between the computed value of the number of engine revolutions is less than a predetermined value.

* * * * *